US008215119B2

(12) United States Patent
Sakai et al.

(10) Patent No.: US 8,215,119 B2
(45) Date of Patent: Jul. 10, 2012

(54) REFRIGERANT FILLING APPARATUS OF REFRIGERATING AND AIR CONDITIONING APPARATUS AND REFRIGERANT FILLING METHOD OF REFRIGERATING AND AIR CONDITIONING APPARATUS

(75) Inventors: Tatsunori Sakai, Tokyo (JP); Masato Yosomiya, Tokyo (JP); Hirokuni Shiba, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 1014 days.

(21) Appl. No.: 12/183,121

(22) Filed: Jul. 31, 2008

(65) Prior Publication Data

US 2009/0114309 A1 May 7, 2009

(30) Foreign Application Priority Data

Nov. 1, 2007 (JP) ..... 2007-284640
Nov. 1, 2007 (JP) ..... 2007-285067

(51) Int. Cl.
*F25B 45/00* (2006.01)

(52) U.S. Cl. ..... 62/77; 62/149; 62/292

(58) Field of Classification Search ..... 62/77, 127, 62/129, 149, 292
See application file for complete search history.

(56) References Cited

U.S. PATENT DOCUMENTS 4,796,436 A 1/1989 Voorhis et al.

FOREIGN PATENT DOCUMENTS

| | | | |
|---|---|---|---|
| EP | 1 983 279 | | 10/2008 |
| JP | 63-011575 | U | 1/1988 |
| JP | 63-011576 | U | 1/1988 |
| JP | 63-161375 | | 7/1988 |
| JP | 03-177762 | A | 8/1991 |
| JP | 03-177763 | A | 8/1991 |
| JP | 03-177764 | A | 8/1991 |
| JP | 04-090866 | U | 8/1992 |
| JP | 05-099540 | A | 4/1993 |
| JP | 06-021749 | | 3/1994 |
| JP | 2526759 | Y2 | 11/1996 |
| JP | 2005-114184 | A | 4/2005 |
| JP | 2005-241172 | | 9/2005 |
| JP | 2005-241172 | A | 9/2005 |
| JP | 2006-010117 | A | 1/2006 |
| JP | 2007-198642 | | 8/2007 |

OTHER PUBLICATIONS

Ground of Rejection issued in corresponding Japanese Application No. 2007-284640 dated Nov. 24, 2009, and an English Translation thereof.

First Office Action issued in corresponding Chinese Application No. 200810144105.9 dated Nov. 13, 2009, and an English Translation thereof.

*Primary Examiner* — Melvin Jones
(74) *Attorney, Agent, or Firm* — Posz Law Group, PLC

(57) ABSTRACT

The present invention is directed to a refrigerant filling apparatus of the refrigerating and air conditioning apparatus that can automatically finish filling of a refrigerant after filling to an appropriate amount, without a need to install an extra valve except for a valve provided at a refrigerant cylinder, in between the refrigerating and air conditioning apparatus and the refrigerant cylinder, which is necessary for filling the refrigerant. The refrigerant filling apparatus of the refrigerating and air conditioning apparatus, which includes: a refrigerant circuit having a compressor 1, a four-way valve 2, an indoor side heat exchanger 3, a pressure reducing solenoid valve 4, an outdoor side heat exchanger 3, and an accumulator 6; a refrigerant cylinder 10 connected to the refrigerant circuit; a control unit that controls filling of the refrigerant from the refrigerant cylinder 10 to the refrigerant circuit and decides refrigerant filling modes; and a display unit installed to the control unit and displays the refrigerant filling modes.

25 Claims, 12 Drawing Sheets

REFRIGERANT FILLING APPARATUS OF REFRIGERATING AND AIR CONDITIONING APPARATUS AND REFRIGERANT FILLING METHOD OF REFRIGERATING AND AIR CONDITIONING APPARATUS

BACKGROUND OF THE INVENTION

1. Field of the Invention

The present invention relates to a refrigerant filling apparatus of the refrigerating and air conditioning apparatus and a refrigerant filling method of the refrigerating and air conditioning apparatus.

2. Description of the Related Art

In general, the refrigerating and air conditioning apparatus configuring a refrigeration cycle comprises an indoor unit, an outdoor unit, and connection pipes connecting the indoor unit to the outdoor unit. The indoor unit includes an indoor side heat exchanger. The outdoor unit includes an outdoor side heat exchanger, a compressor, and a pressure reducing solenoid valve. These are connected to the connection pipes at an inside of the outdoor unit. The indoor unit and the outdoor unit configured accordingly are connected by the connection pipes at an installation site to function as the refrigerating and air conditioning apparatus.

There are various environments for installing the refrigerating and air conditioning apparatus. Depending on the installation environments, the connection pipes of various lengths are used. For this reason, an inner capacity of the refrigeration cycle varies depending on the lengths of the connection pipes. Also, an indoor side heat exchanger 3 has a different capacity depending on an indoor unit B. Therefore, refrigeration cycle capacities differ depending on the installation environments.

A refrigerant that circulates through a refrigerant circuit is required for the refrigerating and air conditioning apparatus to function. Since a required refrigerant amount varies for different refrigeration cycle capacities depending on the installation environments, so that it is difficult to fully fill up the required refrigerant amount in advance in the refrigeration cycles.

Patent document 1 discloses a refrigerant filling apparatus for securing a reliability of the refrigeration cycle, and for automatically filling an appropriate and additional refrigerant amount depending on an installation mode of the conventional refrigeration air conditioning apparatus. The refrigerant cycle of the refrigerant filling apparatus has an outdoor unit including a compressor, an outdoor heat exchanger, a pressure reducing apparatus, and a liquid collecting device, and an indoor unit including an indoor side heat exchanger and a pressure reducing apparatus, which are connected by the connection pipes. A main flow unit of a supercooling heat exchanger providing a sub flow unit is disposed in between the liquid collecting device of the indoor unit and the indoor unit. One end of the sub flow unit is connected to a refrigerant cylinder via a refrigerant filling solenoid valve, and the other end is connected to a suction side of the compressor. According to this refrigerant filling apparatus and the refrigerant filling method, opening and closing of the refrigerant filling solenoid valve is controlled, in relation to a supercooling level of the refrigerant at an outlet of the main flow unit.

Patent document 2 discloses a refrigerant filling method and its apparatus, for providing a refrigerant filling method for a refrigeration cycle capable of automatically and appropriately adjusting the refrigerant amount which is additionally filled at a time of installation of the refrigeration cycle. At trial operation after connecting the outdoor side unit and the indoor side unit with the connection pipes, the refrigerant is filled to a refrigerant circulation path while monitoring predetermined operation parameters that regulate a refrigerant pressure and temperature, a superheating level and/or supercooling level(s) of the refrigerant are detected at each point of the refrigerant circulation path, and filling of the refrigerant stops automatically after the superheating level and/or supercooling level have/has reached since an appropriate amount of the refrigerant is filled.

Patent document 3 discloses a filling method of a heat pump apparatus. A refrigerant supplying source is attached to a filling port of the heat pump apparatus. The refrigerant is filled by a predetermined amount in steps while the compressor is in operation. An inlet temperature and outlet temperature of an indoor coil are detected for every filling of a predetermined amount of the refrigerant. A temperature difference of the two temperatures detected is obtained. The temperature difference is compared with a previously obtained temperature difference. Filling stops when a difference of the temperature differences reaches a threshold value as a result of the comparison.

[Patent document 1] Japanese Laid-Open Patent Publication No. 2005-114184

[Patent document 2] Japanese Laid-Open Patent Publication No. 2005-241172

[Patent document 3] Japanese Patent Publication No. HEI 6-21749

SUMMARY OF THE INVENTION

However, according to the refrigerant filling methods described in the patent documents 1 and 2, an automatic control valve must be provided in between the refrigerant circuit and the refrigerant cylinder, for controlling the refrigerant filling after automatically filling an appropriate amount of the refrigerant to the refrigerant circuit of the refrigerating and air conditioning apparatus. This does not only cause problems in costs and resources, but an usable range of the refrigerating and air conditioning apparatus becomes limited.

According to the refrigerant filling method of the patent document 3, the refrigerant amount is determined from the superheating level of the evaporator, on the other hand, a control method of pressure reducing means that gives a large influence on accumulated refrigerant amounts in a liquid pipe and the condenser is not mentioned. Considering the refrigerant in large is accumulated in the liquid pipe, a highly accurate refrigerant amount adjustment is difficult in the prior art.

Also, it determines that the refrigerant amount is "normal" and "deficient", but it does not determine "excess". As a result of this, an extra step and time are involved in determining whether the refrigerant amount is appropriate or not, by measuring the superheating level at an evaporator outlet if the refrigerant is filled in small amounts. Also, it does not mention about displaying an operation mode to outside, but it mentions that the filling stops, so that this refrigerant filling can be interpreted as automatic. Similar to the patent documents 1 and 2, a specialized valve and a control of the specialized valve should be prepared.

The present invention is directed to a refrigerant filling apparatus and a refrigerant filling method of the refrigerating and air conditioning apparatus, capable of automatically finishing the refrigerant filling after filling the refrigerant to the appropriate amount, without installing any other valve except for a valve installed to the refrigerant cylinder in between the refrigerating and air conditioning apparatus and the refrigerant cylinder needed for filling the refrigerant.

According to the refrigerant filling method of the refrigerating and air conditioning apparatus of the present invention, the refrigerant amount inside the refrigerant circuit is accurately acquired without providing a specialized valve or a specialized control for filling the refrigerant. If the refrigerant amount is "deficient", an instruction or display for filling a predetermined amount of the refrigerant manually at a predetermined time to an appropriate refrigerant level is indicated. Also, a refrigerant filling mistake is taken for granted, and the refrigerant amount of the refrigerant circuit is determined from one of "deficient", "normal" or "excess" mode, to be displayed to a worker.

According to the refrigerant filling apparatus of the refrigerating and air conditioning apparatus of the present invention, a refrigerant circuit having a compressor, a four-way valve, an indoor side heat exchanger, a pressure reducing unit, an outdoor side heat exchanger, and a liquid collecting device; a refrigerant cylinder connected to the refrigerant circuit; a control unit that determines a refrigerant filling mode by controlling the refrigerant filling from the refrigerant cylinder to the refrigerant circuit; and a display unit installed to the control unit and that displays the refrigerant filling mode.

According to the refrigerant filling apparatus of the refrigerating and air conditioning apparatus of the present invention, no other valve except for a valve provided to the refrigerant cylinder in between the refrigerating and air conditioning apparatus and the refrigerant cylinder required for filling the refrigerant is installed. The refrigerant is filled from the refrigerant cylinder to the refrigerating and air conditioning apparatus.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

First Exemplary Embodiment

An air conditioner is described herein as one example of the refrigerating and air conditioning apparatus. Another example of the refrigerating and air conditioning apparatus, besides the air conditioner, is a cooler showcase.

Figure 1:
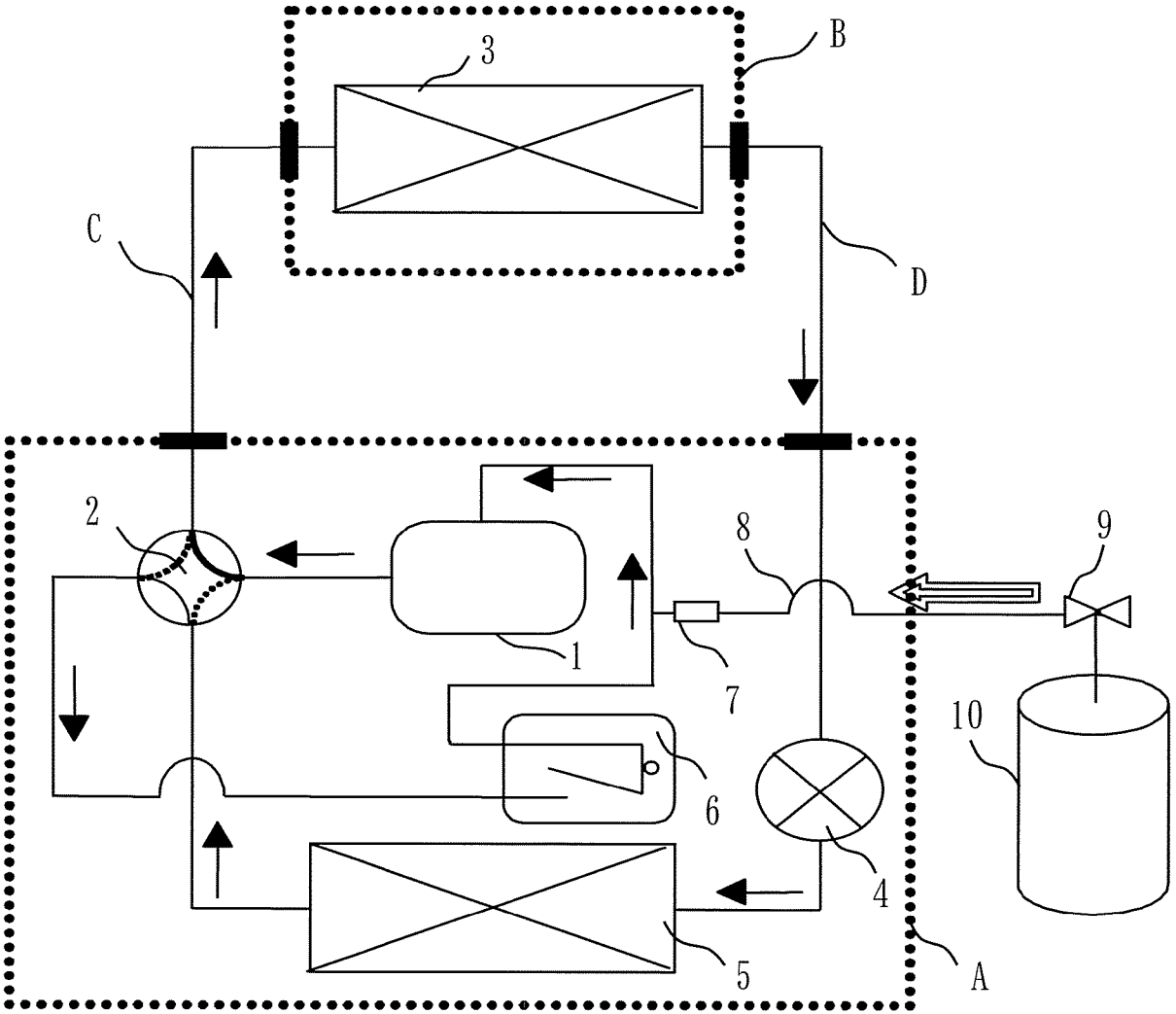
FIG. 1 illustrates a refrigerant circuit at a time of refrigerant filling of the air conditioner, in accordance with a first exemplary embodiment.
Figure 2:
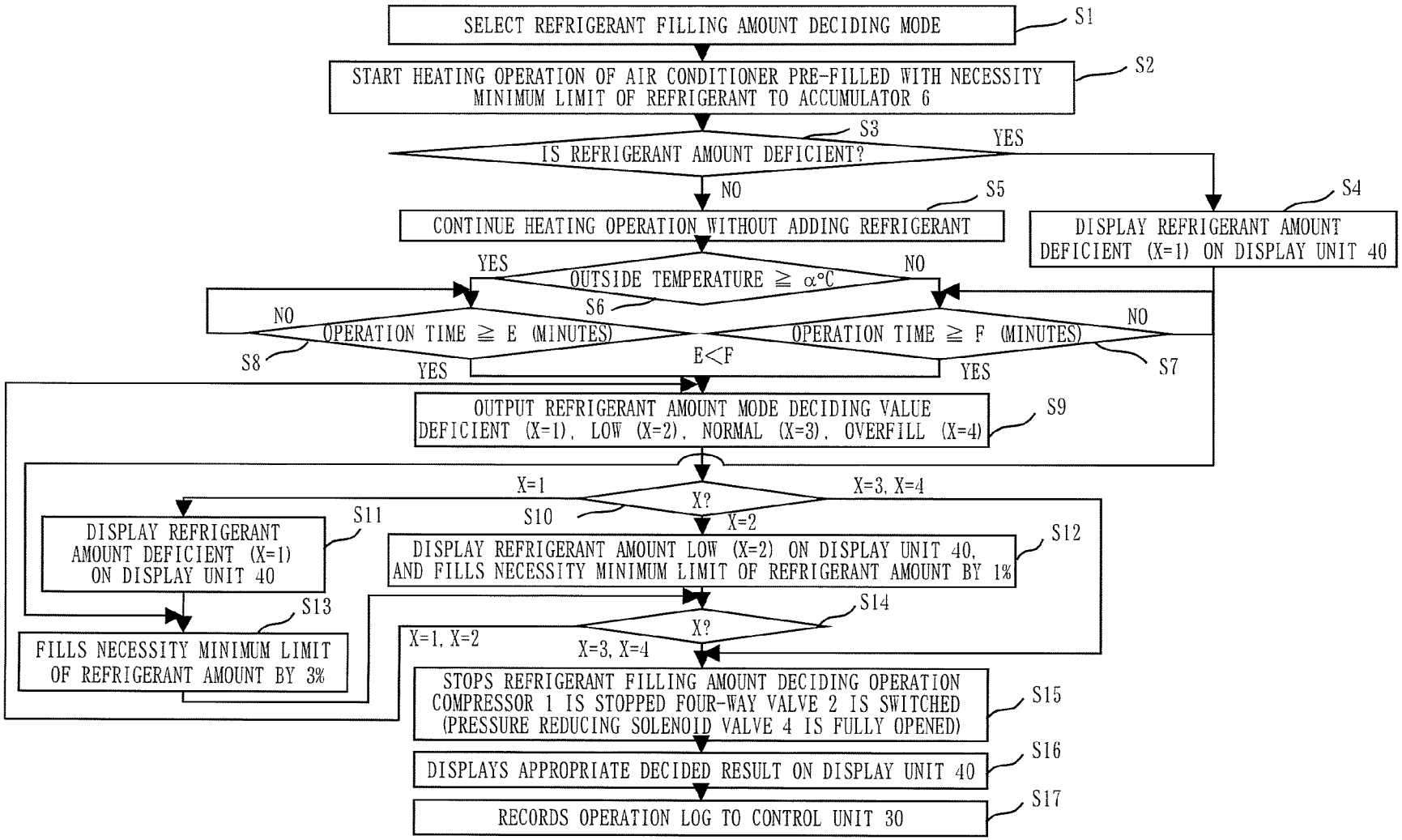
FIG. 2 illustrates a refrigerant filling flowchart showing a refrigerant filling method, in accordance with the first exemplary embodiment.
Figure 3:
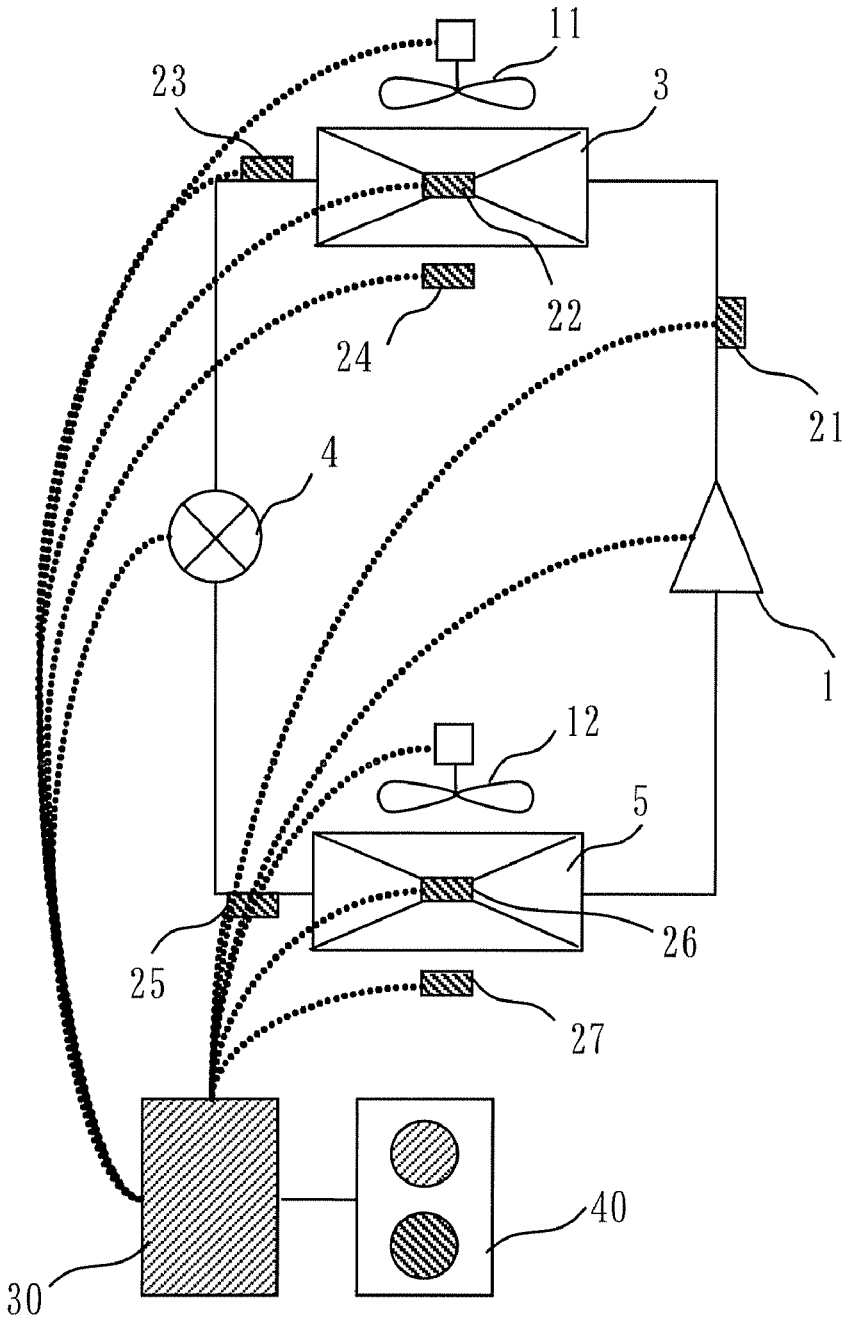
FIG. 3 illustrates a drawing showing an object to be controlled by a control unit 30 when a refrigerant filling amount deciding operation mode has been selected, in accordance with the first exemplary embodiment.
Figure 4:
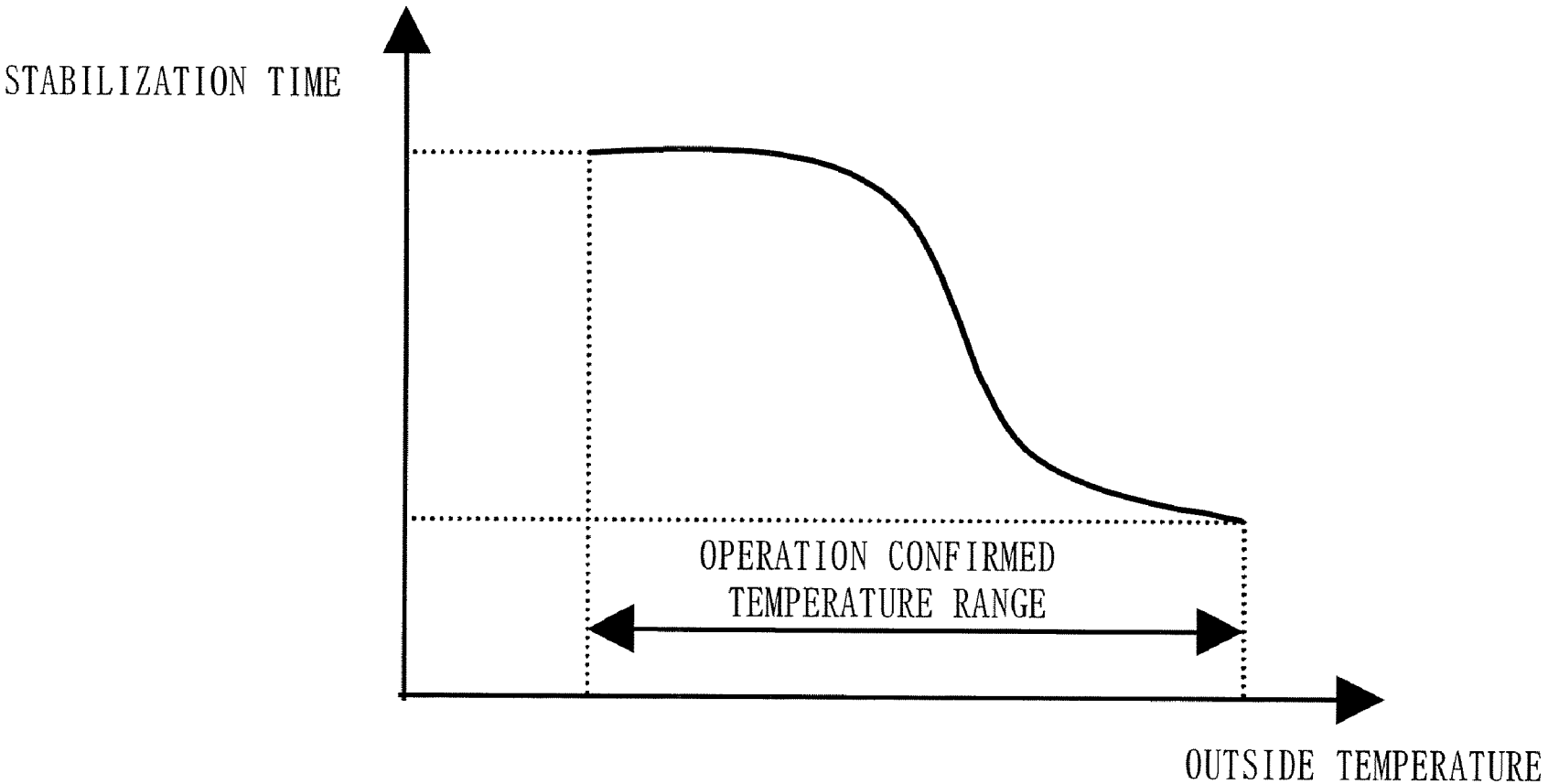
FIG. 4 illustrates a relation of outside temperature and refrigeration cycle stabilization time, in accordance with the first exemplary embodiment.
Figure 5:
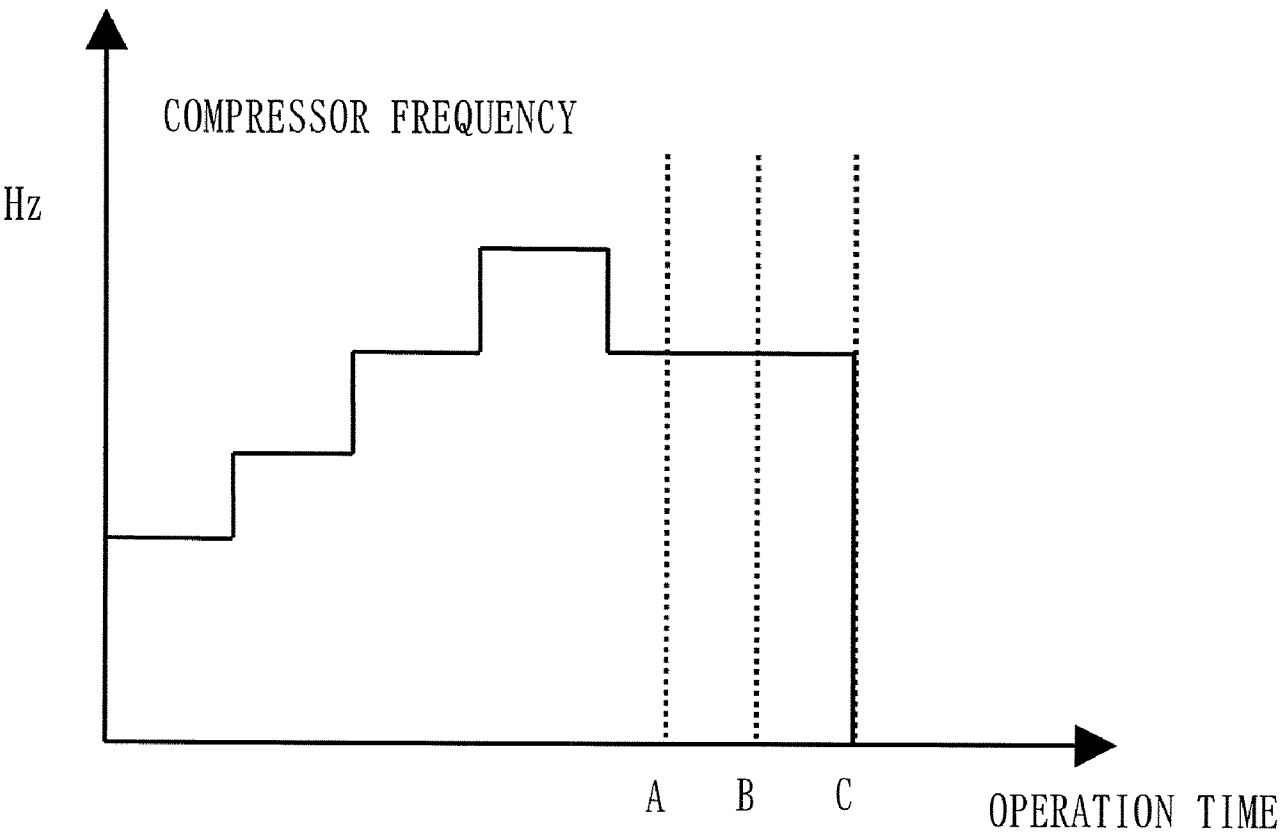
FIG. 5 illustrates a control method of rotation number of a compressor 1 at the time of refrigerant filling, in accordance with the first exemplary embodiment.
Figure 6:
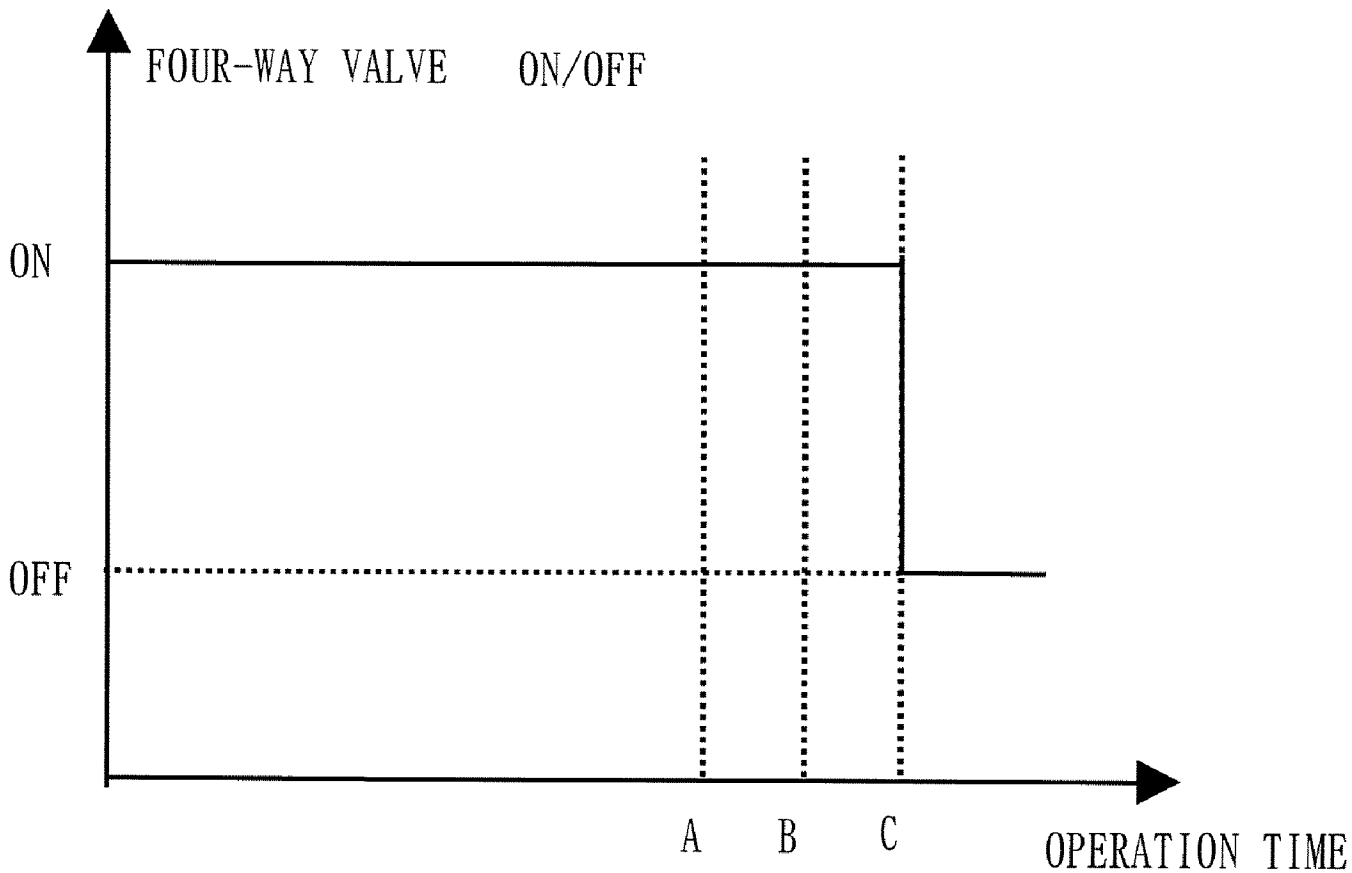
FIG. 6 illustrates a control method of a four-way valve 2 at the time of refrigerant filling, in accordance with the first exemplary embodiment.
Figure 7:
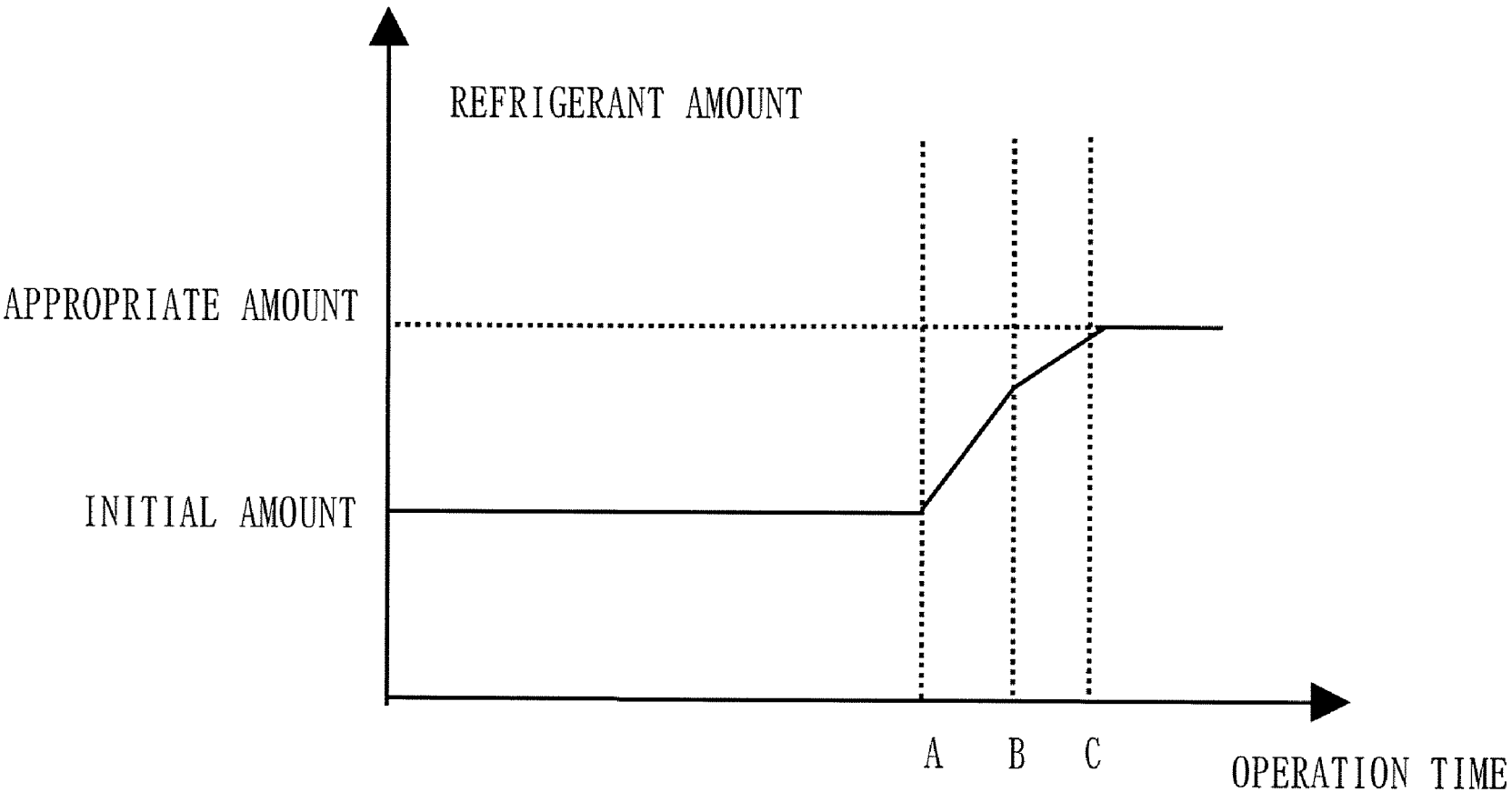
FIG. 7 illustrates a refrigerant filling method at the time of refrigerant filling, in accordance with the first exemplary embodiment.
Figure 8:
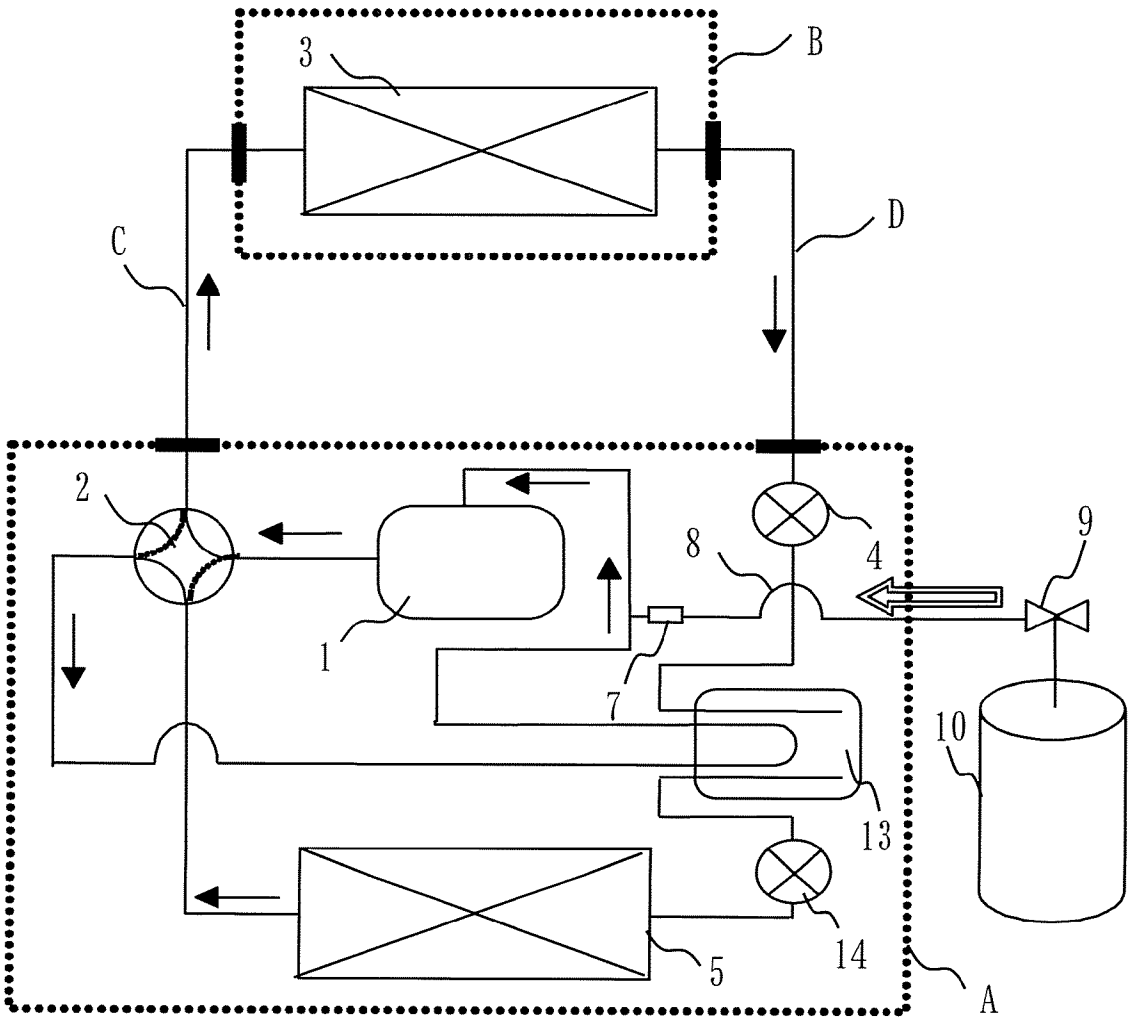
FIG. 8 illustrates a modified example of the refrigeration circuit at the time of refrigerant filling of the air conditioner, in accordance with the first exemplary embodiment.

FIGS. 1 to 8 illustrate the first exemplary embodiment. FIG. 1 illustrates a refrigeration circuit at a time of refrigerant filling of the air conditioner. FIG. 2 illustrates a refrigerant filling flowchart showing a refrigerant filling method. FIG. 3 illustrates an object to be controlled by a control unit 30 when a refrigerant filling amount deciding operation mode has been selected. FIG. 4 illustrates a relation of outside temperature and refrigeration cycle stabilization time. FIG. 5 illustrates a control method of rotation number of the compressor 1 at the time of refrigerant filling. FIG. 6 illustrates a control method of the four-way valve 2 at the time of refrigerant filling. FIG. 7 illustrates a refrigeration cycle during refrigerant filling of the air conditioner. FIG. 8 illustrates a modified example of the refrigeration cycle at the time of refrigerant filling of the air conditioner.

Referring to FIG. 1, the air conditioner includes an outdoor unit A and an indoor unit B. The outdoor unit A installs the compressor 1, the four-way valve 2, a pressure reducing solenoid valve 4 (as one example of the pressure reducing apparatus), an outdoor side heat exchanger 5, and an accumulator 6 (as one example of the liquid collecting device). The indoor unit B installs an indoor side heat exchanger 3.

One end of the outdoor unit A is connected with one end of the indoor unit B with a gas side connection pipe C. On the other hand, the other end of the outdoor unit A is connected with the other end of the indoor unit B with a liquid side connection pipe D. A refrigerant circuit is formed accordingly.

Within the refrigerant circuit formed, the four-way valve 2 installed at the outdoor unit Ahas a role of changing a movement direction of the refrigerant circuit. Normally, a refrigerating and air conditioning apparatus having both cooling and heating functions, performs the cooling operation when a high-temperature and high-pressure refrigerant discharged from the compressor 1 has been sent to the outdoor side heat exchanger 5, and performs the heating operation when it is sent to the indoor side heat exchanger 3. The four-way valve 2 has a role of switching these operation cycles, and can freely switch the operation cycles by switching a slide valve present inside of the four-way valve 2.

On the other hand, the pressure reducing solenoid valve 4 installed at the outdoor unit A has a role of reducing pressure down to a pressure in which a low-temperature and high-pressure refrigerant condensed by a heat exchanger readily evaporates. That is, after the refrigerant is discharged from the compressor 1, it passes through a predetermined path of the refrigerant circuit depending on the cooling or heating operation cycle. The refrigerant maintains the high pressure until it reaches the pressure reducing solenoid valve 4. The refrigerant becomes low in pressure after passing through the pressure reducing solenoid valve 4 until reaching a suction inlet of the compressor 1.

For the apparatus having the refrigerant cycle formed accordingly to function as the air conditioner, the refrigerant must be filled within the refrigerant circuit. A method for filling the refrigerant into the refrigeration circuit of the air conditioner, typically, the refrigerant is filled within the circuit by connecting a refrigerant cylinder 10 to a low pressure side charge port 7, which is present within the refrigerant circuit, via a hose 8, and by opening a refrigerant cylinder valve 9, which is provided at the refrigerant cylinder 10.

Likewise, for a refrigerant filling method of the present embodiment, a similar connection is carried out as a preparation for filling the refrigerant. That is, the refrigerant cylinder 10 having the refrigerant cylinder valve 9 is connected to the refrigerant circuit (to a suction side of the compressor, serving as a low pressure side) via the hose 8, as a preparation step for the refrigerant filling method provided in the present embodiment.

The refrigerant filling method of the air conditioner, after completing the above preparation, is described in accordance to FIG. 2. FIG. 2 illustrates a refrigerant filling flowchart of the refrigerant filling method.

At first, a predetermined switch (not illustrated) pre-mounted to a control unit 30 of the outdoor unit A (refer to FIG. 3) is switched on, and a refrigerant filling amount deciding operation mode is selected in step S1.

If the refrigerant filling amount deciding operation mode has been selected, if the pressure reducing solenoid valve 4 is installed to the outdoor unit A as shown in FIG. 1, the heating operation starts in step S2. In the heating operation, a refrigerant enclosed within the accumulator 6 of the outdoor unit A to a necessity minimum limit circulates through the refrigerant circuit, in a direction indicated by arrows of FIG. 1. Reason for performing a refrigerant filling amount decision in the heating operation is as follows. The necessity minimum limit of the refrigerant is enclosed within the refrigerant circuit (the accumulator 6) of the outdoor unit A, at shipment from factories. No refrigerant is filled in the indoor unit B. Therefore, during air conditioner installation, the outdoor unit A and the indoor unit B are connected in a state of intercepted refrigerant circuit. After releasing air of the outdoor unit B, a vacuum is generated. In this mode, a state of the intercepted refrigerant circuit of the outdoor unit A and the indoor unit B is released. Then, the necessity minimum limit of the refrigerant being pre-filled in the outdoor unit A flows into the indoor unit B, and operation of the air conditioner becomes possible.

A length of the connection pipe (extension pipe) connecting the outdoor unit A to the indoor unit B changes depending on an installation condition. A decision accuracy is increased by performing the refrigerant filling amount decision while the liquid refrigerant are present within this connection pipe (extension pipe). As shown in FIG. 1, if the pressure reducing solenoid valve 4 is present in the outdoor unit A, by performing the heating operation, the refrigerant will be present in the liquid side connection pipe D which is one of the connection pipes (extension pipe). In the cooling operation, a gas-liquid two phase refrigerant flows through the liquid side connection pipe D, the outdoor side heat exchanger 5 serves as a condenser, and the refrigerant exists between the outdoor side heat exchanger 5 and the pressure reducing solenoid valve 4. Accordingly, in the cooling operation, the refrigerant filling amount decision that depends on the length of the connection pipe (extension pipe) would be difficult.

FIG. 3 shows an object to be controlled by a control unit when the refrigerant filling amount deciding operation mode is selected. The air conditioner controls the outdoor unit A and the indoor unit B in order to select an optimal operation condition depending on the environment.

The followings units are installed as temperature detecting units for acquiring refrigerant temperatures within the refrigerant circuit.

(1) a compressor discharge pipe temperature detecting unit 21 for detecting a discharge pipe temperature of the compressor 1 of the outdoor unit A;

(2) an indoor side heat exchanger temperature detecting unit 22 for detecting a temperature of the indoor side heat exchanger of the indoor unit B;

(3) an indoor side heat exchanger outlet temperature detecting unit 23 for detecting a temperature of an outlet of the indoor side heat exchanger of the indoor unit B;

(4) an indoor side discharge outlet temperature detecting unit 24 for detecting an air temperature of a discharge outlet of the indoor unit B;

(5) an outdoor side heat exchanger inlet temperature detecting unit 25 for detecting a temperature of an inlet of the outdoor side heat exchanger of the outdoor unit A;

(6) an outdoor side heat exchanger temperature detecting unit 26 for detecting a temperature of the outdoor side heat exchanger of the outdoor unit A; and (7) an outdoor side discharge outlet temperature detecting unit 27 for detecting an air temperature of a discharge outlet of the outdoor unit A.

In addition to the above, temperature detecting units that detect ambient temperatures of the indoor unit B and indoor unit A, are installed to air suction sides of the indoor unit B and the outdoor unit A, respectively.

The control unit 30 monitors the temperature detecting units (1) to (7) above in real time, and depending on the monitored conditions, controls the compressor 1, the pressure reducing solenoid valve 4, an indoor side fan 11, and an outdoor side fan 12. In this way, a stable operation condition is secured. A role as the air conditioner is achieved.

The control unit 30 has a display unit 40 (for example, a light emitting diode LED) that displays the refrigerant filling modes. The control unit 30 is constructed with a microcomputer implemented on a substrate that is mounted to the outdoor unit A. The control unit 30 at least controls the refrigerant filling from the refrigerant cylinder 10 to the refrigerant circuit.

The refrigerant filling method of the present embodiment also uses each temperature monitored by the temperature detecting units of (1) to (7) above for controlling the air conditioner, determines whether or not an appropriate heating operation mode is secured, and determines the refrigerant amount mode of the refrigerant circuit.

The compressor 1 starts operation in the heating operation of step S2, and the refrigerant circulates through the circuit. When the outside temperature is low, if the gas side connection pipe C and liquid side connection pipe D are long, and if the refrigerant amount enclosed within the accumulator 6 is extremely lacking, the refrigerant circuit is operated under a refrigerant amount "low" mode.

In this case, the filling amount of the refrigerant circuit does not meet the necessity minimum limit, and the compressor 1 discharges the refrigerant, but a sucked refrigerant is not being circulated, so that a pipe path which leads from the accumulator 6 to the compressor 1 becomes a vacuum. The above operation mode is likely to lead to a failure of the compressor 1, so that if the refrigerant amount is "deficient", a fact that the refrigerant is extremely lacking is immediately notified, and refrigerant filling is promptly urged. The display unit 40 displays that the refrigerant is "deficient" (X=1, which will be described later) in step S4. The display unit 40 (LED) receives a signal from the control unit 30, and notifies a worker by blinking, for example, and the refrigerant filling is promptly urged.

The refrigerant cycle stabilizes if the refrigerant amount is not deficient in step S3, and while an appropriate refrigerating amount mode is being determined, an operation is performed as it is without adding the refrigerant amount in step S5.

The operation of step S5 is vital in securing a reliability of the refrigerant cycle itself, and it is not just required in determining the appropriate refrigerant amount circulating within a current refrigerant circuit.

Operation time taken until the refrigeration cycle is stabilized depends on the outside temperature.

In step S6, the outside temperature is compared with a predetermined temperature α° C. The predetermined temperature α° C. is 10° C., for example.

When the outside temperature is low, a high-temperature and high-pressure refrigerant discharged at the compressor 1 is cooled by an outside air while passing through the pipe before reaching the indoor side heat exchanger 3 (the condenser). Therefore, a difference between a condensation temperature and a room temperature is small, and the supercooling level is almost zero. In this case, in order to elevate the refrigerant temperature without being affected by the outside temperature, a frequency of the compressor 1 must be increased. It takes time for the refrigeration cycle to stabilize and the condensation temperature to increase.

If the outside temperature is lower than the predetermined temperature α° C. in step S6, a process advances to step S7 to decide whether or not a predetermined time F (minutes) has elapsed. If the predetermined time F (minutes) has not elapsed in step S7, the control unit 30 is in a refrigerant filling amount decision-in-progress time, and an operation is further performed by refraining the refrigerant filling. The predetermined time F (minutes) is a time for stabilizing the refrigerant cycle and elevating the condensation temperature, for example, 20 minutes. The predetermined time F (minutes) is an experimentally obtained value of a time taken for the refrigerating and air conditioning apparatus to reach a stable operation, in each outside air condition. A relationship between the time and the outside temperature before reaching the refrigerant cycle stabilization is shown in FIG. 4. As illustrated in FIG. 4, as for an operation confirmed temperature range of the outside temperature, when the outside temperature is low, a time taken before reaching the stable operation of the refrigeration and air conditioning apparatus is long, which is longer than when the outside temperature is high.

On the other hand, when the outside temperature is high, compared with a case of low outside temperature, a time taken to the refrigeration cycle stabilization is shortened. This is because the condensation temperature is high, even if the frequency of the compressor 1 is low. ].

If the outside temperature is higher than the predetermined value α° C. in step S6, a process advances to step S8 to decide whether or not a predetermined time E (minutes) has passed. The predetermined time E (minutes) is a time shorter than the predetermined time F (minutes) of step S7. The predetermined time E (minutes) is a time for stabilizing the refrigerant cycle and elevating the condensation temperature, for example, 12 minutes. When the predetermined time E (minutes) has not elapsed in step S8, the control unit 30 is in the refrigerant filling amount decision-in-progress time, and an operation is further performed by refraining the refrigerant filling.

Accordingly, differences in the stabilization times of the refrigerant cycles are considered, and the operation time of not adding the refrigerant amount is amended, depending on the outside temperature.

Next, a displaying method of a refrigerant amount mode deciding value X of step S9 in a refrigerant filling method flowchart shown in FIG. 2 is described.

After a standby time specified by the outside temperature (E or F, in minutes) has passed, among factors showing refrigeration cycle modes, the refrigerant amount mode deciding value X calculated by a supercooling level and a condensation temperature parameter is output. The refrigerant amount mode deciding value X is calculated in real time according to the refrigeration cycle mode which changes by every minutes. As calculated parameters, the supercooling level after shifting to a refrigeration cycle stabilization mode, and a difference between a condensation temperature and a room temperature, are used. The refrigerant amount mode deciding value X is determined based on a value range which is obtained by subtraction of the supercooling level and the difference between the condensation temperature and the room temperature.

A result is displayed by a displaying unit 40 (LED) mounted on a substrate of the control unit 30 of the outdoor unit A. As a displaying method of the LED, various signals are accurately communicated by giving variation to blinking patterns of a single LED. For example, considering 6 seconds as one set, the LED is blinked once, twice, three times, and four times during this time to indicate "deficient", "low", "normal" and "overfill" levels of the refrigerant amount present within the refrigerant circuit, for communicating the refrigerant amount mode deciding values output in real time.

That is, if the operation time is F (minutes) and more in step S7, and if the operation time is E (minutes) and more in step S8, the process advances to S9, and the refrigerant amount mode deciding value X calculated by the supercooling level and condensation temperature parameter is output. The refrigerant amount mode deciding value X is classified into the following four levels.

X=1 (refrigerant amount is deficient)
X=2 (refrigerant amount is low)
X=3 (refrigerant amount is normal)
X=4 (refrigerant amount is overfill)

The refrigerant amount mode deciding value X is calculated by the control unit 30 in real time according to a refrigeration cycle mode which changes by every minutes. A calculated result of the control unit 30 is displayed on the display unit 40 (for example, LED) disposed on a substrate (not illustrated) of the outdoor unit A.

Next, a refrigerant filling method when a result of the refrigerant amount is determined as lacking in step S10 of the refrigerant filling method flowchart of FIG. 2. is described next.

As a result of the decision, when the refrigerant amount is determined as low, the process shifts to a refrigerant filling operation.

X=1 or X=2 is decided in step S10. If X=1 or X=2, a process advances to step S11, and the refrigerant is filled.

If a refrigerant amount is "deficient" (X=1), then a "refrigerant amount deficient (X=1)" is displayed on the display unit 40 in step S11.

Then, 3% of the refrigerant amount pre-filled to the necessity minimum limit is filled to the refrigeration circuit (for example, the accumulator 6) in step S13. This is performed in every 1 minutes. A reason why the refrigerant amount at one filling is set to 3% of the pre-filled refrigerant amount is as follows.

That is, when the refrigerating and air conditioning apparatus is shifting to a stable operating condition, a distribution of the refrigerant circulating through the refrigerant circuit varies in places, which is most likely to be dispersed. In this operation mode, when 3% and more refrigerant filling is performed to an initial refrigerant amount, it becomes a refrigeration cycle operation having locally high refrigerant density. This deviates from the stable operation mode of the refrigeration cycle. In this mode, an accurate decision is difficult, and there is going to be a disadvantage of taking too much time in shifting to the stable operation mode. For the above reason, a maximum value of refrigerant filling per minute is controlled.

If the refrigerant amount is "low" (X=2), the display unit 40 displays "refrigerant amount is low (X=2)", and within 1% of the refrigerant amount pre-filled to the necessity minimum limit is filled to the refrigeration circuit (for example, the accumulator 6) in step S12.

For the refrigerant cycle reflecting an additional refrigerant amount to enter a stable mode by adding the refrigerant amount, there is going to be a time difference from the added point. For this reason, when a refrigerant within 1% of the refrigerant amount pre-filled to the necessity minimum limit is added continuously to the refrigerant circuit, starting from the from the "refrigerant amount low (X=2) mode", a point in time where the refrigerant filling has been decided as "normal", an actual refrigerant amount is likely to be in an "excess" mode. Accordingly, there is a need to successively decrease the additional refrigerant amount as a decided value gets close to the appropriate refrigerant amount.

Next, a step of deciding a refrigerant amount "normal" (X=3) or refrigerant amount "overfill" (X=4), and stopping the refrigerant filling amount deciding operation mode is described, at a time of the refrigerant filling amount decision of step S14 of the refrigerant filling method flowchart shown in FIG. 2.

Based on the refrigerant filling method above, in step S14, when the refrigerant amount "normal" (X=3) or refrigerant amount "overfill" (X=4) has been determined in an initial deciding time or as a result of repeating the additional refrigerant filling, an operation for deciding the refrigerant amount shifts to a stop mode.

That is, X is determined in step S14, and when X=3 or X=4 in step S14, the process advances to step S15, and because the refrigerant amount is "normal", the process shifts to the operation stop mode, and the refrigerant filing amount deciding operation stops in step S15. The compressor 1 automatically stops when the process shifts to the operation stop mode. At the same time as a stop of the compressor 1, a determined result "normal" is displayed on the display unit 40 (LED) that is mounted on the substrate of the outdoor unit A, in step S16. From this, a worker can acquire information on a completion of the refrigerant filling operation.

Further, when the refrigerant filling amount deciding operation stops, the compressor 1 stops, and the four-way valve 2 is switched. Further, the pressure reducing solenoid valve 4 is fully opened in step S15. As for the refrigerant circuit shown in FIG. 1, the refrigerants of various states, namely, a high-temperature and high-pressure refrigerant flowing from a discharge side of the compressor 1, and a normal temperature and low-pressure refrigerant flowing in from the outdoor side heat exchanger 5, passes through by sandwiching a partition provided at an inside of the four-way valve 2.

According to the refrigerant filling method of the present embodiment, a refrigerant cylinder 10 is connected to a low pressure side of the refrigerant circuit via a hose 8, and a pressure decline in the connection pipe of the refrigerant circuit which occurs from operating the air conditioner is utilized for smooth filling of the refrigerant into the circuit, owing to a pressure difference.

However, even after the refrigerant has been filled properly, since there is no control valve in between the refrigerant cylinder 10 and the refrigerant circuit, there is a danger that the refrigerant keeps on filling as it is.

Thus, the four-way valve 2, where various states of the refrigerants are flowing through as described above, is switched, and the respective refrigerants are by-passed, so that a pressure inside the refrigerant circuit becomes uniform. From this, there is no pressure difference between the refrigerant circuit and the refrigerant cylinder 10. The refrigerant filling more than it is necessary after finishing the refrigerant filling operation can be controlled.

Further, there is a pressure reducing solenoid valve 4 in the refrigerant circuit as an apparatus for creating the pressure difference. In the heating operation shown in FIG. 1, the pressure reducing solenoid valve 4 has a role of transforming a low-temperature and high-pressure liquid refrigerant flowing in from the indoor side heat exchanger 3 to a low-temperature and low-pressure air and liquid two phase refrigerant, by adjusting a cross-sectional area of a path.

That is, while the air conditioner is in the process of operation, a pressure difference occurs at front and back of the pressure reducing solenoid valve 4. This pressure reducing solenoid valve 4 in fully opened at the same time as finishing the refrigerant filling operation. That is, the cross sectional area of the path on the circuit is uniformed so that the pressure difference does not occur, and the pressure inside the refrigerant circuit is unified in the similar manner as the four-way valve 2. This also plays a role in suppressing the refrigerant filling more than it is necessary after finishing the refrigerant filling operation.

Next, recording of an operation log after finishing the refrigerant amount deciding operation mode of step S7 in the refrigerant filling method flowchart shown in FIG. 2, is described.

After finishing the refrigerant filling operation, the operation log is recorded on the substrate of the outdoor unit A in step S17. By recording a refrigerant filling operation condition immediately before, such as an inspection time of the air conditioner, a worker can acquire information on how the refrigerant filling operation has been carried out in the past, and able to examine immediately on how the refrigeration cycle was being operated at what refrigerant amount mode. This reduces a load put on a maintenance of the air conditioner, and enables to improve on a system use.

In implementing the refrigerant filling method of the present embodiment, the refrigerant filling step at a time of refrigerant amount mode deciding operation mode, and operations of the compressor 1 and the four-way valve 2 that perform control during operation, will be described.

FIG. 5 shows one example of a frequency control performed by the compressor 1. FIG. 6 shows one example of switching control performed by the four-way valve 2. FIG. 7 shows a refrigerant filling condition. The respective drawings are for the refrigerant amount mode deciding operation mode.

As shown in steps S1 and S2 of the flowchart of FIG. 2, the heating operation starts by selecting the refrigerant filling deciding operation mode. At the same time, the compressor 1 that received a signal from the control unit 30 starts operating, and the four-way valve 2 is switched, and a refrigerant flow direction of the refrigerant circuit for the heating operation is secured.

The compressor 1 continues to increase the frequency from a start of its operation, and prompts refrigerant circulation. In this way, a stable refrigerant cycle operation under a temperature environment which it is placed under is secured. At this time, the following elements of FIG. 3 are utilized for deciding whether or not a stable condition of the refrigeration cycle has been secured, namely: the temperature detecting unit, the compressor discharge pipe temperature detecting unit 21, the indoor side heat exchanger temperature detecting unit 22, the indoor side heat exchanger outlet temperature detecting unit 23, the indoor side outlet temperature detecting unit 24, the outdoor side heat exchanger inlet temperature detecting unit 25, the outdoor side heat exchanger temperature detecting unit 26, and the outdoor side outlet temperature detecting unit 27. The compressor 1 changes the frequency by every minutes depending on monitored conditions.

After the refrigeration cycle is stabilized and a predetermined operation time selected in steps S7 or S8 of FIG. 2 has passed, a decided result is output as in step S9. If decided as "refrigerant amount deficient (X=1)", this step corresponds to an operation time A of FIGS. 5 to 7, and the refrigerant filling starts from this step as shown in FIG. 7.

After filling of the refrigerant as instructed, it reaches an operation time B of FIGS. 5 to 7, and further fills the refrigerant amount as instructed in FIG. 7, after confirming a change of refrigerant filling amount per minute on the display.

When the refrigerant filling operation is repeated and the refrigerant filling amount is decided as "normal", the process shifts to a stop mode of the refrigerant filling deciding operation, as shown in step S15 of the flowchart of FIG. 2.

This step corresponds to an operation time C shown in FIGS. 5 to 7. It stops almost at the same time as receiving an operation stop mode shifting signal by the compressor 1. The four-way valve 2 is also switched immediately. This controls filling of the refrigerant more than the current level.

Further, a first modified example of the refrigerant circuit at the time of refrigerant filling of the air conditioner is shown in FIG. 8. The refrigerant circuit shown in FIG. 8 is a receiver circuit having a power receiver 13. Compared with the refrigerant circuit shown in FIG. 1, the power receiver 13 is attached in place of the accumulator 6, and it incorporates a connection pipe in between the indoor side heat exchanger 3 and outdoor side heat exchanger 5, and has a pressure reducing solenoid valve 4 and a secondary pressure reducing solenoid valve 14 at front and back of it.

The power receiver 13, attached in place of the accumulator 6, has a role of a tank that collects an excess refrigerant, the tank of which was possessed at the accumulator 6. Further, it has a role of increasing an operation efficiency by pouring a low-temperature and high-pressure air and liquid phase refrigerant at the pressure reducing solenoid valve 4 into the power receiver 13, and just the liquid is collected at the outlet, which is further pressure reduced at the secondary pressure reducing solenoid valve 14. The liquid refrigerant is efficiently pressure reduced in two steps.

The refrigerant circuit of FIG. 8 is a refrigeration cycle which closely resembles an accumulator circuit shown in FIG. 1 by fully opening the secondary pressure reducing solenoid valve 14, therefore, needless to say that the similar refrigerant filling method as the first exemplary embodiment can be utilized.

Second Exemplary Embodiment

Figure 9:
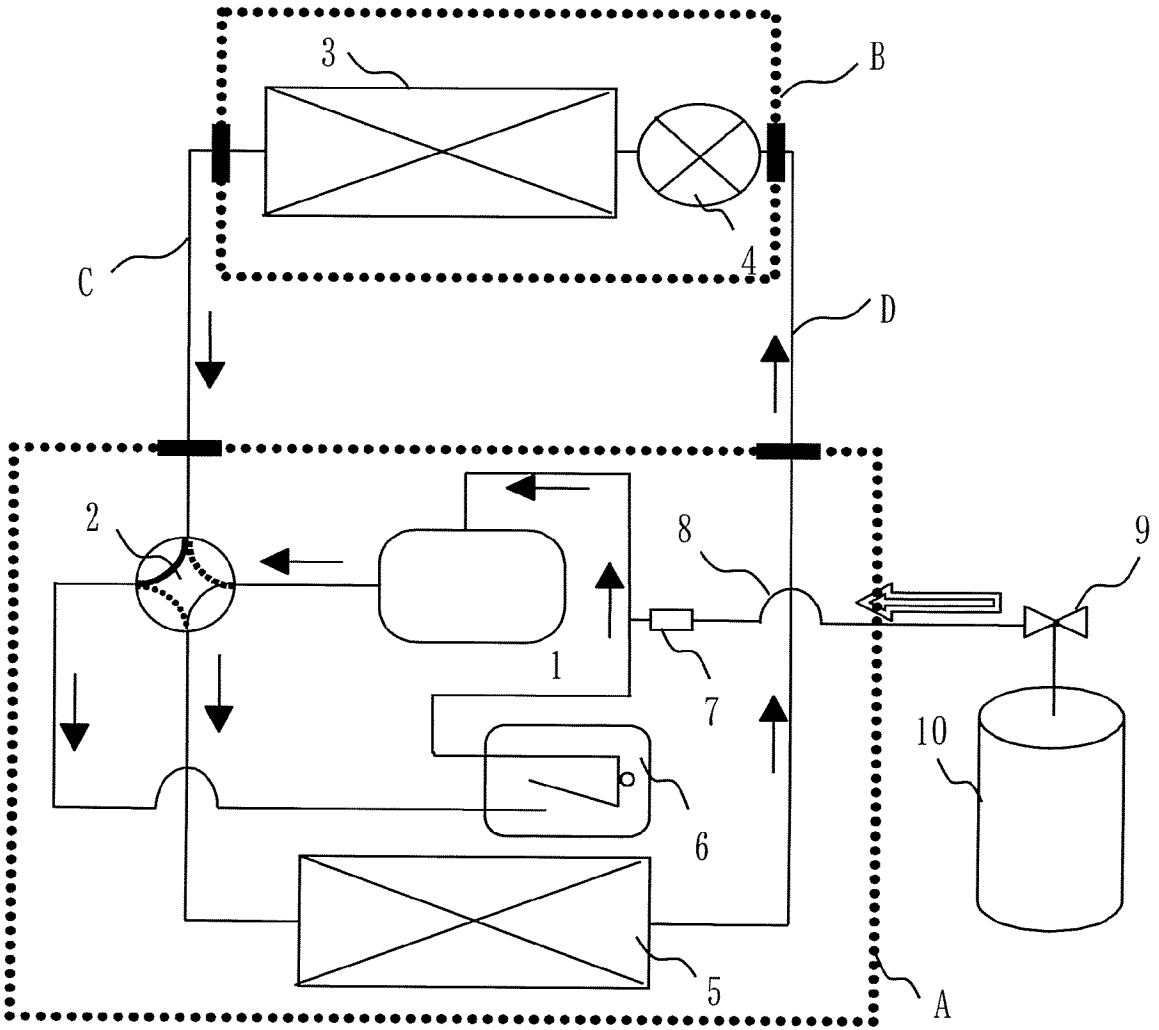
FIG. 9 illustrates a refrigerant circuit at the time of refrigerant filling of the air conditioner, in accordance with a second exemplary embodiment.

FIG. 9 shows a refrigerant circuit at the time of refrigerant filling of the air conditioner, in accordance with the second exemplary embodiment. Unlike FIG. 1, the pressure reducing solenoid valve 4 is installed to the indoor unit B side.

When the pressure reducing solenoid valve 4 is installed to the indoor unit B, the refrigerant circuit is looped in a direction of the arrows of FIG. 9, which is similar in contents as the refrigerant filling method of the first exemplary embodiment. That is, to acquire the refrigerant amount mode, if the pressure reducing solenoid valve 4 is located at the outdoor unit A side, this is an indication that the heating operation is required. However, if it is located at the indoor unit B side, this is an indication that the cooling operation is required.

A section in the refrigerant circuit which requires the refrigerant amount at most, in other words, a density of the refrigerant is the highest, is a path from the condenser (the outdoor side heat exchanger 5) to a liquid side connection pipe D. This causes liquidification of the refrigerant at this section. Needless to say, there is a large difference in densities at a gas state and liquid state. Within the refrigerant circuit, for the most part, the refrigerant passes through at the gas state, however, when considering in terms of refrigerant amount, a liquid section possesses the most refrigerant amount. Thus, in case of applying the refrigerant filling method of the present invention that examines the refrigerant amount modes by adjusting the pressure reducing solenoid valve 4, the refrigeration cycle (the cooling operation) that can acquire the density of the above section is ideal.

Third Exemplary Embodiment

Figure 10:
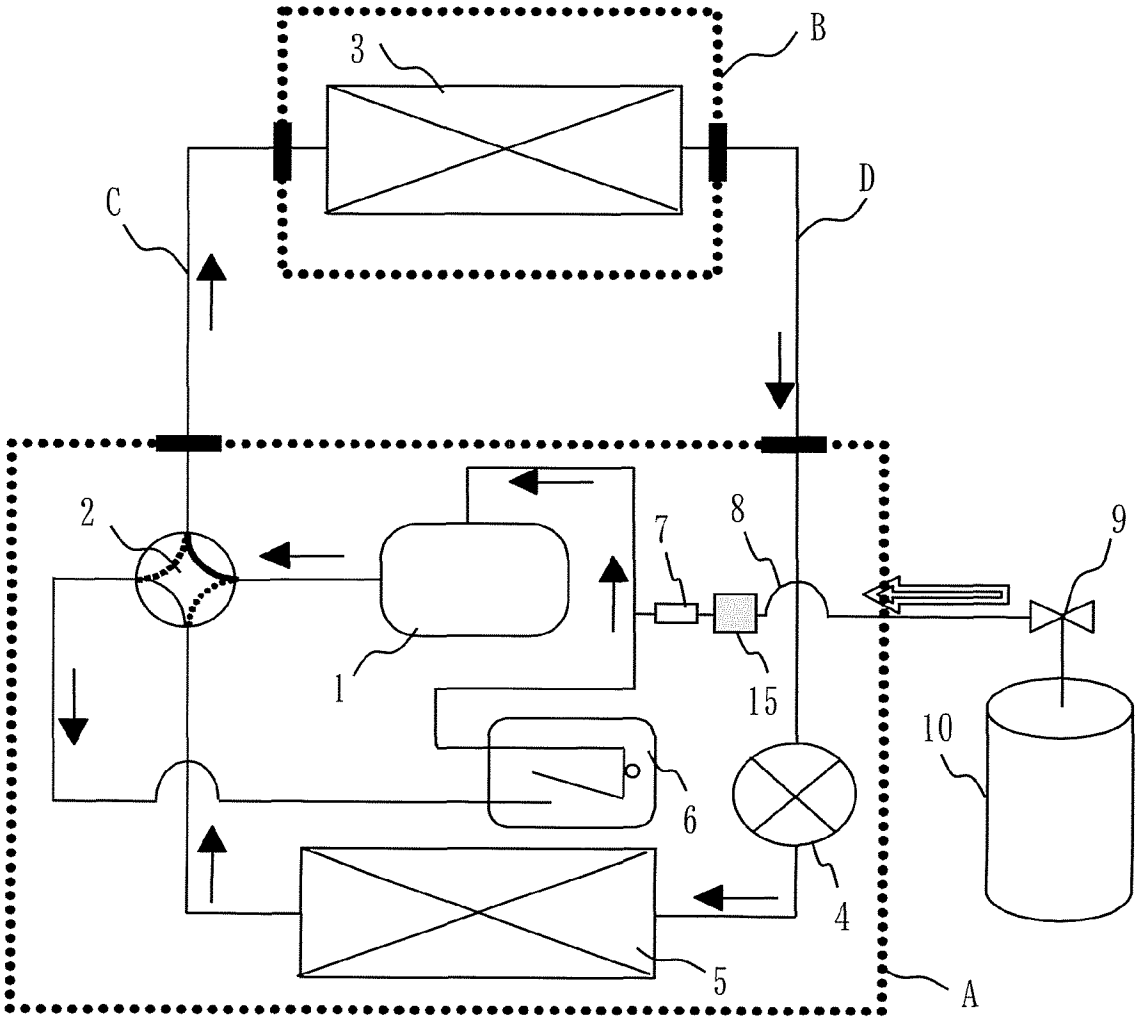
FIG. 10 illustrates a refrigerant circuit at the time of refrigerant filling of the air conditioner, in accordance with a third exemplary embodiment.

On the other hand, a refrigerant filling method shown in FIG. 10 having an automatic control valve 15 in between the refrigerant cylinder 10 and the refrigerant circuit, and having a similar refrigerant circuit as FIG. 1, the operation methods described previously are usable.

FIG. 10 illustrates a refrigerant circuit at the time of refrigerant filling of the air conditioner, in accordance with the third exemplary embodiment.

According to the refrigerant filling method of the present invention, at a stage of determining the refrigerant amount "normal", the heating operation mode is stopped, the compressor 1 is stopped at the same time as switching the four-way valve 2, and then, the pressure reducing solenoid valve 4 is fully opened. In this way, a pressure difference in the refrigerant circuit that arises from the heating operation is removed. In consequence of these, an excessive refrigerant filling hereafter is controlled.

In contrast to this, the circuit shown in FIG. 10 adds the automatic control valve 15 in between the refrigerant cylinder 10 and the refrigerant circuit that allows switching of opening and closing operation by an outdoor unit control. While the refrigerant filling amount deciding operation is performed, the automatic control valve 15 is open for filling the refrigerant. The automatic control valve 15 is closed to immediately terminate the refrigerant filling after stopping of the operation based on the refrigerant amount decided as "normal".

The most important feature of the refrigerant circuit of FIG. 10 is that the refrigerant filling after the refrigerant filling amount deciding operation stop can be stopped completely, by closing the automatic control valve 15. From this, the refrigerant amount can be filled in more accurately. Improvement in a reliability of the product is assured.

Fourth Exemplary Embodiment

An air conditioner as one example of the refrigerating and air conditioning apparatus is described hereinbelow. As the refrigerating and air conditioning apparatus, other than the air conditioner, there is a refrigeration showcase, for example.

Figure 11:
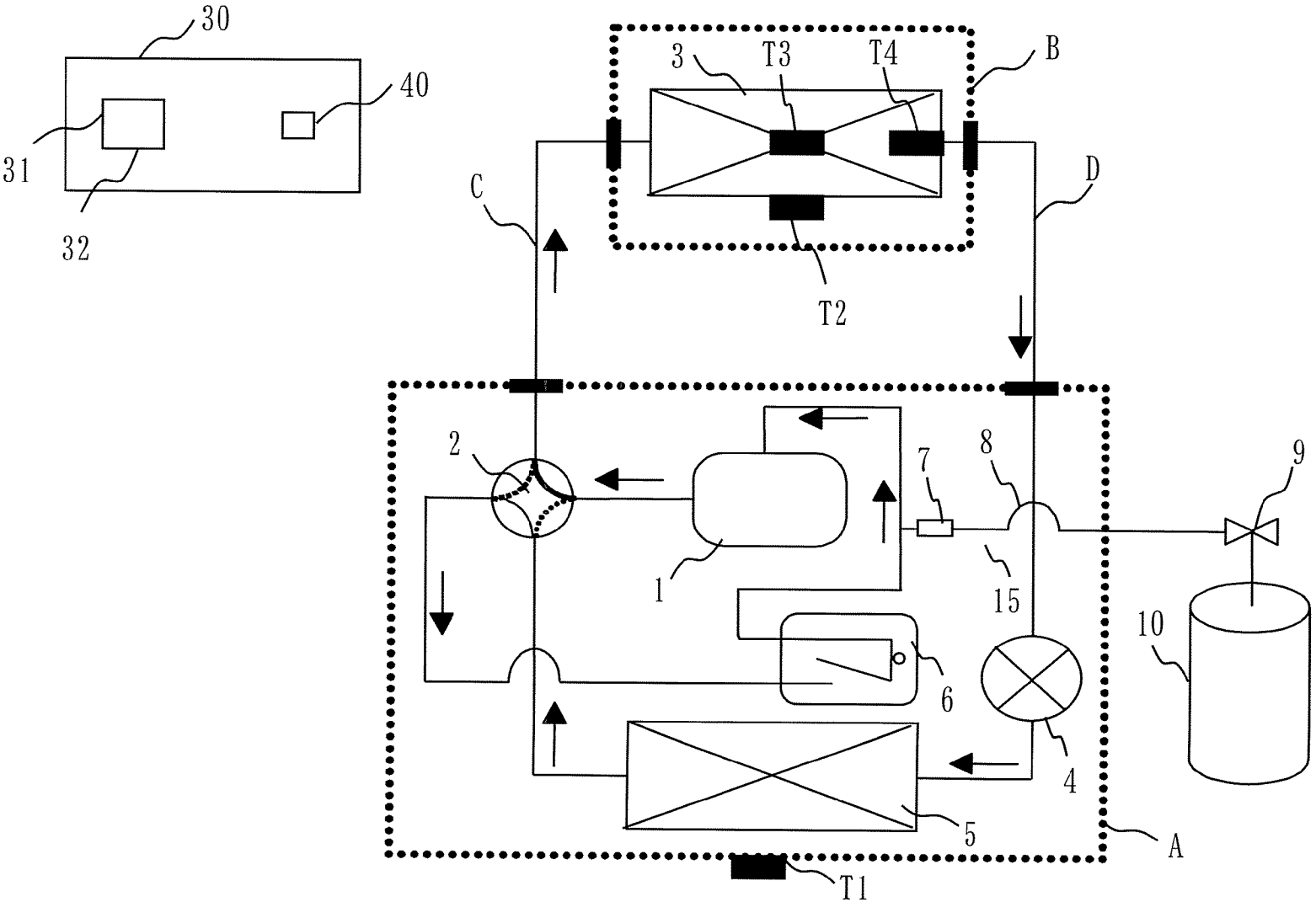
FIG. 11 illustrates a refrigerant circuit at the time of refrigerant filling of the air conditioner, in accordance with fourth and sixth exemplary embodiments.
Figure 12:
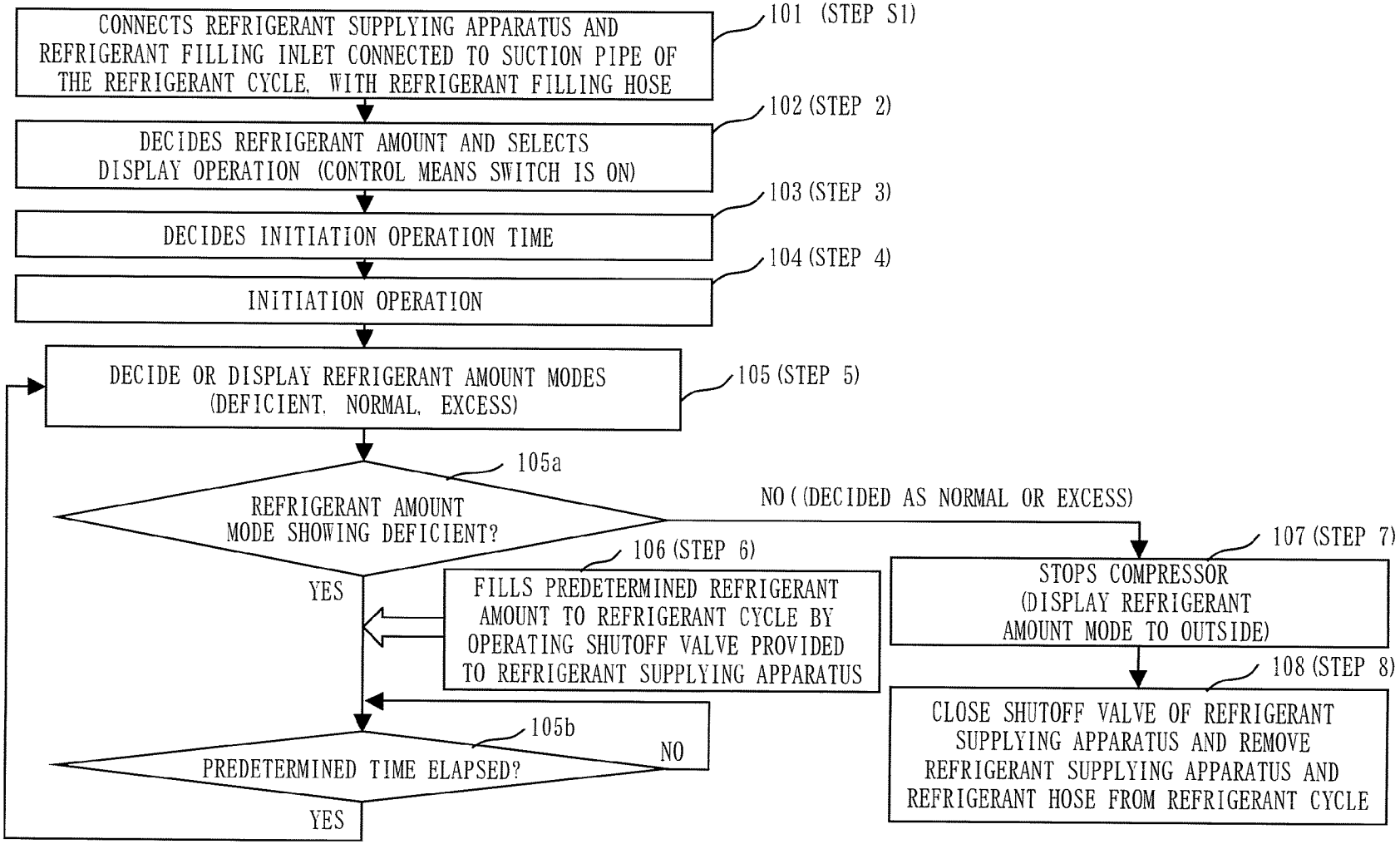
FIG. 12 illustrates a refrigerant filling flowchart showing the refrigerant filling method, in accordance with the fourth and sixth exemplary embodiments.

FIG. 11 is a drawing showing a refrigeration circuit at the time of refrigerant filling of the air conditioner, in accordance with the fourth exemplary embodiment. FIG. 12 is a refrigeration filling flowchart showing the refrigeration filling method, in accordance with the fourth exemplary embodiment.

Referring to FIG. 11, the air conditioner is provided with the outdoor unit A and the indoor unit B. The outdoor unit A comprises a compressor 1, a four-way valve 2, a pressure reducing solenoid valve 4 serving as a pressure reducing apparatus, an outdoor side heat exchanger 5, and an accumulator 6 (an example of the liquid collecting device). The indoor unit B is provided with an indoor side heat exchanger 3, and the like.

One end of the outdoor unit A and one end of the indoor unit B is connected with a gas side connection pipe C. On the other hand, the other end of the outdoor unit A and the other end of the indoor unit B is connected with a liquid side connection pipe D. A refrigeration cycle is formed accordingly.

Within the refrigerant circuit formed, the four-way valve 2 installed to the outdoor unit A has a role of changing a flow movement of the refrigerant circuit. Normally, a refrigerating and air conditioning apparatus having both the cooling and heating functions, performs the cooling operation when a high-temperature and pressure refrigerant discharged from the compressor 1 has been sent to the outdoor side heat exchanger 5, and performs the heating operation when it is sent to the indoor side heat exchanger 3. The four-way valve 2 has a role of switching these operation modes, making it capable of freely switching the operation modes (cooling and heating) by switching a slide valve inside the four-way valve 2. Then, at a time of the heating operation, the indoor side heat exchanger 3 serves as a condenser that condenses the refrigerant, and the outdoor side heat exchanger 5 serves as an evaporator that evaporates the refrigerant. At a time of the cooling operation, in reverse, the indoor side heat exchanger 3 serves as the evaporator, and the outdoor side heat exchanger 5 serves as the condenser.

On the other hand, the pressure reducing solenoid valve 4 installed to the outdoor unit A depressurizes a high-temperature liquid refrigerant condensed by the indoor side heat exchanger 3 and the outdoor side heat exchanger 5 down to an evaporation pressure.

Temperature detecting means such as thermister is described next. Referring to FIG. 11, T1 denotes outside unit temperature detecting means for detecting an ambient temperature of the outdoor unit A; T2 denotes indoor unit ambient temperature detecting means for detecting an ambient temperature of the indoor unit B; T3 denotes two-phase refrigerant temperature detecting means for detecting a two-phase refrigerant temperature inside the indoor side heat exchanger 3; and T4 denotes outlet temperature detecting means for detecting an outlet temperature of connecting side of the liquid side connection pipe D of the outdoor side heat exchanger 3. The control unit 30 includes refrigerant filling deciding means 32 for deciding the refrigerant amount inside the refrigerant circuit and includes storing means 31 that stores a threshold value of a decision of the refrigerant amount deciding means 32, controls operation modes of a compressor 1, a pressure reducing solenoid valve 4, an outside fan motor (not illustrated), an indoor fan motor (not illustrated), and stores values detected by the outdoor unit temperature detecting means T1, the indoor unit ambient temperature detecting means T2, the two-phase refrigerant temperature detecting means T3, and the outlet temperature detecting means T4, to the storing means 31. A decided result of the refrigerant amount mode is displayed on the display unit 40. Examples of the display unit 40 are a LED lamp and a remote control display unit provided on the control unit 30. Also, according to one example of the present embodiment, the control unit 30 serving as a control apparatus is constructed with a micro-computer mounted substrate, to be disposed on the outdoor unit A.

For the apparatus having the refrigerant circuit formed accordingly to function as the air conditioner, the refrigerant must be present within the refrigeration circuit.

The refrigerant amount filling method of the air conditioner is described with reference to FIG. 12.

First of all, a hose connecting step S101 serving as a first step is performed. In the hose connecting step S101, a refrigerant cylinder 10 serving as a refrigerant supplying apparatus for connecting to the refrigerant circuit and for supplying the refrigerant to be filled, and a low pressure side charge port 7 connected to a suction pipe serving as a low pressure side of the refrigerant circuit, are connected with a refrigerant filling hose 8. It should be noted that, the refrigerant cylinder 10 providing a refrigerant cylinder valve 9, which is transferable, is assumed as the refrigerant supplying apparatus.

An operation selecting step S102 serving as a second step is described. The operation selecting step S102 selects a start of refrigerant filling operation that performs refrigerant amount deciding and displaying operation by the refrigerant amount deciding means 32 and the display unit 40. When a predetermined switch (not illustrated) mounted to the control device 30 is ON, the air conditioner selects a refrigerant amount deciding and displaying operation mode. If the refrigerant amount deciding and displaying operation mode is selected, a refrigerant circuit is constructed which is capable of the heating operation in the case of the present embodiment where the pressure reducing solenoid valve 4 is provided to the outdoor unit A. A flow of the refrigerant at a time of the heating operation is illustrated by arrows of FIG. 11. In the apparatus provided with the pressure reducing solenoid valve 4 at the outdoor unit A, the refrigerant amount deciding and displaying operation is performed in the heating operation. The reason for this is, a high-pressure liquid refrigerant is being filled inside the connection pipe at the heating operation, so that if the connection pipe is long, the necessary refrigerant amount is greater for the heating operation than the cooling operation, so that the refrigerant amount can be decided accurately. For the same reason, the cooling operation is selected as the refrigerant amount deciding and displaying operation mode in the apparatus provided with the pressure reducing solenoid valve 4 at the indoor unit B.

Next, a time deciding step S103 for deciding a predetermined time for performing an initiation operation serving as a third step is described. In the time deciding step 103, the control unit 30 decides the predetermined time for performing the initiation operation of an initiation operation step S104 which will be described later. An initiation operation time is decided from an outside temperature serving as an ambient air temperature detected by the outdoor temperature detecting means T1 of the outdoor ambient temperature. A relation with the detected temperature of the outdoor temperature detecting means T1 and the initiation operation time is stored in advance on the storing means of the control unit 30. The initiation operation time is set long, because the lower the temperature, the refrigerant cycle is stabilized even more. The initiation operation time is a time required for stabilizing the refrigerant cycle for accurately performing the refrigerant amount decision of the refrigerant cycle, and approximately 10 minutes is the standard. Further, the initiation operation time can be set long for stabilizing the refrigerant cycle at low outside temperature, however, depending on the outside temperature, the time can be decided uniquely, which is effective in preventing an energy loss or refrigerant filling operation becoming too long, by not performing the initiation operation more than it is necessary, in case that the outside temperature is not low.

Next, an initiation operation step S104 serving as a fourth step is described. In the initiation operation step S104, the predetermined time initiation operation decided in the time deciding step S103 is executed when the refrigerant filling operation that decides and displays the refrigerant amount is selected in the operation selecting step S102. That is, the compressor 1 starts operation and performs the initiation operation. The initiation operation time is a time decided in the time deciding step S103 of the third step. During this time, a fact of initiation operation in progress, is displayed to the display unit 40 of the control unit 30, using symbols, numbers or by blinking. Their meanings are described on a back of a simple removable panel of the outdoor unit A or are written in a handling manual. The compressor 1, the pressure reducing solenoid valve 4, and the outdoor fan motor are variably controlled so that the refrigerant cycle is stabilized.

Next, a deciding and displaying step S105 (includes steps S105*a* and 105*b*) serving as a fifth step is described. According to the deciding and displaying step S105 (includes steps S105*a* and 105*b*), after the initiation operation time of the initiation operation step S104 has passed, every time a predetermined time elapses, a supercooling level of the condenser (the outdoor side heat exchanger 3 in the present embodiment), and an ambient air temperature of the condenser 3 are detected by the indoor ambient temperature detecting means T2, and based on values of the supercooling level and the ambient air temperature, the refrigerant amount deciding means 32 decides the refrigerant amount of the refrigerant circuit as one of "deficient", "normal", and "excess" modes. The result of the decision is displayed on the display unit 40. That is, temperatures are detected at the indoor ambient temperature detecting means T2, the two-phase refrigerant temperature detecting means T3 of the indoor side heat exchanger 3, and the liquid refrigerant outlet temperature detecting means T4 of the indoor side heat exchanger 3. The supercooling level is obtained from the temperature values of the latter two, which are combined with the indoor ambient temperature to be used in deciding the refrigerant filling.

Threshold values and functions between a relation of the supercooling level and the indoor unit ambient temperature, and the refrigerant amount of the refrigerant circuit as of "deficient", "normal", and "excess" modes, are previously stored on the storing means 31 of the control unit 30 in advance. These are compared by the refrigerant amount deciding means 32, the refrigerant amount mode is decided in step S105*a*, and "deficient", "normal" and "excess" modes are indicated on the display unit 40 by using symbols, numbers, and blinking, in step S105. Their meanings are described in a handling manual or written on a back of the panel of the outdoor unit A. After the initiation operation time has passed, the refrigerant amount decision and display are implemented for every predetermined time in step 105*b*. The predetermined time of 1 to 2 minutes is preferred, by taking account of a time constant of the refrigeration cycle. Further, to give some examples of "deficient", "normal" and "excess" modes of the display unit 40, for example, a LED is blinked for "deficient" mode, the LED is slowly blinked for "normal" mode, and the LED is blinked quickly for "excess" mode. Alternatively, three LED may be installed separately to indicate their respective modes.

Next, the refrigerant filling step S106 serving as a sixth step is described. In the refrigerant filling step S106, the compressor 1 continues operation while the refrigerant amount deciding result of the deciding and displaying step S105 (the step S105*a*) is the refrigerant amount "deficient" mode, the refrigerant cylinder valve 9 provided at the refrigerant cylinder 10 is operated, and the refrigerant is filled to the refrigerant circuit.

That is, in the deciding and displaying step of the fifth step, if the refrigerant amount is decided as "deficient", the compressor 1 continues operation. During this time, a worker manually handles the refrigerant cylinder valve 9 of the refrigerant cylinder 10, and ideally, an optional refrigerant amount is filled to the refrigerant circuit at an optional timing. A time required in an actual refrigerant filling operation, which includes preparation, filling, cleaning up, and checking of the displaying means, is about 2 to 3 minutes per single filling. For a worker who has no idea of how much refrigerant should be filled for each filling, it would be ideal to describe on a handling manual the recommended refrigerant amount filling for each time. Further, when the sixth step (the refrigerant filling step 106) is not operated, a state of the fifth step (the deciding and displaying step 105, 105*a*, and 105*b*) continues.

Next, a stopping and displaying step S107 serving as a seventh step is described. The stopping and displaying step S107 stops the compressor 1 and displays the refrigerant amount mode by the display unit 40, if the refrigerant amount decided result of the deciding and displaying step S105 (step S105*a*) shows the refrigerant amount as one of "normal" or "excess".

That is, in the deciding and displaying step S105 of the fifth step, if the refrigerant amount decided result is a "normal" mode, the refrigerating and air conditioning apparatus automatically stops the compressor 1. A fact that the refrigerant amount mode is "normal" or "appropriate" is displayed on the displaying unit 40. A worker finishes filling operation when the compressor 1 stops or by looking into the display. At this time, a manual refrigerant cylinder valve 9 of the refrigerant cylinder 10 stays open. To cease the refrigerant filling operation of the refrigerant circuit after the compressor 1 stops, it is effective to switch a path of the four-way valve 2 within few seconds so that the refrigerant circuit is under an equal pressure within a short time. That is, due to the refrigerant circuit which is under the equal pressure, a difference between a pressure of the refrigerant cylinder 10 and a pressure at connection unit of the refrigerant becomes small, so that filling of the refrigerant becomes difficult. Moreover, a pressure releasing noise at a time of switching the four-way valve 2 can be heard by a worker so that the refrigerant amount mode is "normal" or "excess" is acquired without having to look into the displaying unit 40, or without having to check for the compressor 1 stop. The refrigerant filling operation is readily performed. Moreover, it would be ideal to store on the storing means 31 that the decided result as one of "normal" or "excess", and that the filling operation of the refrigerant to this refrigerant circuit is implemented. These would be information beneficial for an after service maintenance of the air conditioner apparatus.

A shutoff valve closing step S108 serving as an eighth step is described next. In the shutoff valve closing step S108, the compressor 1 stops in the stopping and displaying step 107, and after the refrigerant amount mode is displayed, the refrigerant cylinder valve 9 provided to the refrigerant cylinder 10 is closed.

That is, in the shutoff valve closing step S108 of the eighth step, the compressor 1 stops, and after having confirmed that the refrigerant amount mode of the refrigerant circuit as one of "normal" or "excess" on the display unit 40, the refrigerant cylinder valve 9 provided at the refrigerant cylinder 10 is manually closed.

Accordingly, a refrigerant filling method of the refrigerating and air-conditioning apparatus, which comprises: a refrigerant circuit having a compressor 1, a four-way valve 2, a condenser, a pressure reducing solenoid valve 4, an evaporator, and an accumulator 6 serving as a liquid collecting apparatus; a temperature detecting means that detects an ambient air temperature of the condenser or a refrigerant circuit temperature; a control unit 30 includes refrigerant filling deciding means 32 which decide the refrigerant amount inside the refrigerant circuit, and includes storing means 31 that stores a threshold value of a decision of the refrigerant amount deciding means 32; and a refrigerant cylinder 10 connected to the refrigerant circuit. The refrigerating filling method comprises the following steps. A hose connecting step S101 that connects the refrigerant cylinder 10 and the low pressure side charge port 7 of the refrigerant circuit connected by the refrigerant filling hose 8. An operation selecting step S102 that selects an operation for deciding and displaying the refrigerant amount by the refrigerant amount deciding means 32 and the displaying apparatus 40. An initiation operation step S104 that performs an initiation operation for a predetermined time, when the operation for deciding and displaying the refrigerant amount is selected at the operation selecting step S102. A deciding and displaying step S105 (includes steps S105*a* and 105*b*), after an initiation operation time by the initiation operation step S104 has passed, a supercooling level of the condenser and an ambient air temperature of the condenser are detected by the temperature detecting means, and every time the predetermined time passes, the refrigerant amount deciding means 32 decides the refrigerant amount mode of the refrigerant circuit as from one of "deficient", "normal" or "excess" based on the supercooling level and the ambient temperature value, and displays the decided result on the display unit 40. A refrigerant filling step S106 that fills the refrigerant to the refrigerant circuit by operating the refrigerant cylinder valve 9 provided to the refrigerant cylinder 10, while continuing operation of the compressor 1, during the refrigerant filling deciding result of the deciding and displaying step S105 indicates the refrigerant amount "deficient" mode. A stopping and displaying step S107 that displays the refrigerant amount mode by the displaying unit 40 while stopping the compressor 1, during the refrigerant amount deciding result indicating refrigerant amount as one of "normal" or "excess". The refrigerant amount inside the refrigerant circuit can be acquired accurately without having to prepare a special valve or a special control for supplying the refrigerant. Moreover, the refrigerating and air conditioning apparatus decides the refrigerant amount modes of the refrigerant circuit as one of "deficient", "normal" or "excess" for a predetermined time. Since the refrigerant amount is indicated to a worker, a worker can manually operate the shutoff valve of the refrigerant supplying apparatus, and an optional refrigerant amount is filled to the refrigerant circuit at an optional timing, and an appropriate refrigerant amount is filled. Moreover, if the refrigerant amount of the refrigerant circuit becomes excess by mistake during operation, the refrigerating and air conditioning apparatus decides the excess mode and displays to a worker. Effectively, a worker can set the refrigerant inside the refrigerant circuit to an appropriate level by recycling an excess refrigerant.

Further, a refrigerant circuit having a compressor 1, a four-way valve 2, a condenser, a pressure reducing solenoid valve 4, an evaporator, and an accumulator 6; a temperature detecting means that detects an ambient air temperature of the condenser or a refrigerant circuit temperature; a control unit 30 includes refrigerant filling deciding means 32 which decide the refrigerant amount inside the refrigerant circuit, and includes storing means 31 that stores at least a threshold value of a decision of the refrigerant amount deciding means 32; a display unit 40 that displays the refrigerant amount mode determined at the refrigerant amount deciding means 32 by notifying to outside; and a refrigerant cylinder 10 connected to the refrigerant circuit. The refrigerant amount deciding means 32 decides a refrigerant amount mode of the refrigerant circuit from one of "deficient", "normal" and "excess", and displays the decided result to the display unit 40. The refrigerant amount inside the refrigerant circuit can be grasped accurately without having to prepare a special valve or special control for supplying the refrigerant. Since the refrigerant amount is indicated to a worker, a worker can manually operate the shutoff valve of the refrigerant supplying apparatus, and a refrigerant is filled to the refrigerant circuit easily. Especially, when the refrigerant "excess" mode is determined and displayed to a worker, the worker can recycle the excess refrigerant and enables to optimize the refrigerant within the refrigerant circuit effectively.

Fifth Exemplary Embodiment

The air conditioner as one example of the refrigerating and air conditioning apparatus is described.

FIG. 11 shows a refrigerant circuit of the fifth exemplary embodiment. FIG. 12 shows a refrigerant filling flowchart identical to the first exemplary embodiment. The detailed explanation of circuit configuration and operation are omitted for this embodiment being similar to the first exemplary embodiment. An initiation operation step S104 of the present embodiment is described next.

The initiation operation step S104 starts operation by initiating the compressor 1. An initiation operation time is uniquely decided from an ambient temperature of the outdoor unit A. The time is set short if the ambient temperature of the outdoor unit A is high, and the time is set long if the temperature is low.

The refrigerant can circulate through the refrigerant circuit in a short time if the extension pipe is short in length, which is ranging from several meter to 30 meters. In this case, a refrigerant distribution inside the refrigerant circuit is stabilized after few tens of seconds to several minutes counting from a start of the initiation operation. The refrigerant pressure inside the condenser also increases. As a result of this, there is a tendency that a temperature difference of the two-phase refrigerant temperature of the condenser (the indoor side heat exchanger 3 in the example of the present embodiment) and the ambient temperature of the condenser to become large. For example, a threshold value of the temperature difference of the ambient temperature of the condenser and the two-phase refrigerant temperature of the condenser is set to 6 deg, and a predetermined time is set to several minutes (3 to 5 minutes). If the extension pipe length is short, which is ranging from several meters to 30 meters, the temperature difference between the two-phase refrigerant temperature of the condenser and the ambient temperature of the condenser becomes greater than the threshold value after the predetermined time has passed.

On the other hand, among the air conditioners, there is an air conditioner in which the refrigerant is filled to the outdoor unit in advance, by a volume of the extension pipe having a length of several tens of meters. In general, this is called a chargeless specification, which is employed to various models of package air conditioners for shops and offices.

As an example, a R410A refrigerant is employed, with an initial refrigerant filling amount of 4.3 kg, and an outdoor unit having 5 HP, at 30 m chargeless specification. A standard gas pipe diameter for 5 HP is 15.88 mm, and a liquid pipe diameter is 9.52 mm. The additional refrigerant amount is set as 0.06 kg per 1 m. In this case, the refrigerant amount collected at the pipe is 1.8 kg, and the remaining 2.5 kg is collected at the outdoor unit and the indoor unit.

If a pipe that connects this outdoor unit to the indoor unit is 5 meters long, 1.5 kg (25 m×0.06 kg/m=1.5 kg) corresponding to 25 m refrigerant volume is in excess. 1.5 kg correspond to the 35% of the whole volume, therefore, the refrigerant amount is in excess when the refrigerant filling decision is performed by the deciding and displaying step S105.

If a pipe length is short, differences of refrigerant circuit collected refrigerant amounts (required refrigerant amount) at the cooling operation, the heating operation, and a defrost operation are small, therefore, even if the refrigerant amount within the refrigerant circuit is in excess, the excess refrigerant corresponding to a required refrigerant amount difference at each operation can be collected at the accumulator 6, therefore, there is no problem in terms of reliability. For this reason, when the pipe length is short, the refrigerant amount might be determined "normal" up to an excessive mode causing the reliability problem.

The refrigerant amount decision is determined by a relationship between the supercooling level of the condenser and the ambient temperature of the condenser. Decision is "excess" if the supercooling level is large, and "deficient" if the supercooling level is small. What is ordinarily determined as "excess" mode can be determined as "normal" by setting a threshold value of the supercooling level that separates the "normal" and "excess" modes. For example, 8 deg setup is set to 16 deg.

As described above, if the difference between the two-phase refrigerant temperature of the condenser and the ambient temperature of the condenser after 3 to 5 minutes lapse from the initiation operation start becomes 6 deg and more, for example, in the deciding and displaying step S105, the threshold value that divides the refrigerant amount "normal" and "excess" in the deciding and displaying step S105 is changed to an increasing direction of the supercooling level (for example, 8 deg to 16 deg). If the pipe length is short, what is ordinarily determined as "excess" can be determined as "normal", and an extra step of considering whether the refrigerant refilling is required or not can be omitted.

Sixth Exemplary Embodiment

The refrigerating and air conditioning is described as one example of the air conditioner.

FIG. 11 illustrates a refrigerant circuit in accordance with the sixth exemplary embodiment. FIG. 12 shows a refrigerant filling flowchart in accordance with the sixth exemplary embodiment. The present embodiment is identical to the fourth exemplary embodiment, so that the detailed description is omitted since it has the same circuit configuration and operation as the fourth exemplary embodiment. An initiation operation step S104 of the present embodiment is described next.

If the refrigerant amount inside the refrigerant circuit is significantly lacking, a low pressure declines during the operation, and the compressor 1 may likely to become a negative pressure suction state. If a negative pressure suction operation continues, a valve may fail or a shaft friction may occur inside the compressor 1, and the compressor 1 may likely to fail. At this time, a refrigerant circulation amount of the refrigerant circuit is almost zero, therefore, the two-phase refrigerant temperature of the condenser and the ambient temperature of the condenser are almost the same.

For example, a threshold value of the temperature difference is 3 deg, and a predetermined time is set to 10 minutes.

If the refrigerant amount is significantly lacking, the difference between the two-phase refrigerant temperature of the condenser and the ambient temperature of the condenser after the predetermined time elapses after the initiation operation start, is less than the threshold value.

If the above mode has generated, the refrigerant amount "deficient" must be informed quickly so that a refrigerant amount "deficient" is decided to be displayed immediately after its detection.

As above, if a difference between the two-phase refrigerant temperature of the condenser and the ambient temperature is 2 deg and less after 10 minutes from the initiation operation start, the refrigerant amount is determined as "deficient", which is displayed, and a reliability of the compressor is secured.

As described in the fourth to sixth embodiments, according to the refrigerant filling method of the air conditioning apparatus of the present invention, which comprises: a refrigerant circuit having a compressor, a four-way valve, a condenser, a pressure reducing apparatus, an evaporator, and a liquid collecting device; temperature detecting means that detects a temperature of the refrigerant circuit and a temperature of the refrigerant circuit and an ambient air temperature of the condenser; control means that includes storing means and refrigerant amount deciding means which decide a refrigerant amount inside the refrigerant circuit; display means that informs to outside by displaying refrigerant amount mode determined in the refrigerant amount deciding means; and a refrigerant supplying apparatus connected to the refrigerant circuit. The refrigerant filling method comprises: an initiation operation step for performing an initiation operation for a predetermined time; a deciding and displaying step that detects the supercooling level of the condenser and the ambient air temperature of the condenser, after an initiation operation time has passed, every time a predetermined time elapses, by the temperature detecting means, that decides the refrigerant amount from one of "deficient", "normal" or "excess" modes of the refrigerant circuit based on the supercooling level and the ambient temperature value, and that displays the decided result to the displaying means; a refrigerant filling step that fills the refrigerant to the refrigerant circuit by operating a shutoff valve provided to the refrigerant supplying apparatus while the compressor continues operation, during the refrigerant amount "deficient" mode is indicated based on the refrigerant deciding result of the deciding and displaying step; and a stopping and displaying step that displays the refrigerant amount by the displaying means while stopping the compressor, if the refrigerant amount deciding result of the deciding and displaying step indicates the refrigerant amount from one of "normal" or "excess" modes. The refrigerant amount inside the refrigerant circuit can be acquired accurately without having to prepare a special valve or special control for supplying the refrigerant. Since the refrigerant amount is determined from one of "deficient", "normal" or "excess" modes is determined to be indicated to a worker, the worker can manually operate the shutoff valve of the refrigerant supplying apparatus, and an optional refrigerant amount is filled to the refrigerant circuit at an optional timing, and an appropriate refrigerant amount is filled. Moreover, if the refrigerant amount of the refrigerant circuit becomes excess by mistake during operation, the refrigerating and air conditioning apparatus decides the excess mode and displays to the worker. Effectively, the worker can set the refrigerant inside the refrigerant circuit to an appropriate level by recycling the excess refrigerant.

A time deciding step that decides a predetermined time of the initiation operation of the initiation operation step which is decided by the control means is provided, so that the initiation operation time can be determined efficiently.

The predetermined time for performing the initiation operation is uniquely decided by the outside temperature, therefore, a time necessary for the initiation operation can be determined effectively.

After the compressor has stopped in the stopping and displaying step, and the refrigerant amount mode is displayed, the shutoff valve closing step that closes the shutoff valve provided to the refrigerant supplying apparatus is provided, therefore, a worker can easily carry out the refrigerant filling operation.

The indoor unit and the outdoor unit is provided, and the refrigerant circuit capable of the heating operation when the pressure reducing apparatus is mounted to the outdoor unit, and capable of the cooling operation when the pressure reducing apparatus is mounted to the indoor unit. Thus, the pressure reducing apparatus can be located at either one of the indoor unit and the outdoor unit, and the refrigerant can be filled.

The refrigerant amount of the refrigeration cycle can be determined accurately, because a rotation number of the compressor and a pressure reducing amount of the pressure reducing means change so that the refrigerant temperature mode of the refrigerant circuit changes to a target value.

If the refrigerant amount deciding result of the deciding and displaying step is "deficient", and the refrigerant filling step cannot be implemented, the deciding and displaying step continues, the refrigerant filling operation of the refrigerant circuit is easily performed.

If the compressor stops due to "normal" or "excess" mode of the refrigerant amount deciding result at the stopping and displaying step, a path of the four-way valve is switched within several seconds after the compressor stops, so that an overfilling of the refrigerant becomes unlikely.

A worker hears a sound of switching the path of the four-way valve, the compressor stop due to the refrigerant amount deciding result "normal" or "excess" is notified, therefore the worker can understand the operation step.

Further, according to the refrigerant filling apparatus of the air conditioning apparatus of the present invention as described in the above embodiments, which comprises a refrigerant circuit having a compressor, a four-way valve, a condenser, a pressure reducing apparatus, an evaporator, and a liquid collecting device; temperature detecting means that detects a temperature of the refrigerant circuit and a temperature of the refrigerant circuit and an ambient air temperature of the condenser; control means that includes refrigerant amount deciding means which decide a refrigerant amount inside the refrigerant circuit, and includes storing means that stores at least a threshold value of a decision of the refrigerant amount deciding means; display means that informs to outside by displaying refrigerant amount mode determined in the refrigerant amount deciding means; and a refrigerant supplying apparatus connected to the refrigerant circuit. The refrigerant amount deciding means decides the refrigerant amount of the refrigerant circuit from one of "deficient", "normal", and "excess" modes, and displays the decided result from one of "deficient", "normal", and "excess" modes of the refrigerant amount. In this way, the refrigerant amount modes of the refrigerant circuit can accurately be acquired from one of "deficient", "normal", and "excess" modes without having to prepare a special valve or a special control for supplying the refrigerant by displaying to a worker, therefore, the worker can manually operate the shutoff valve of the refrigerant supplying apparatus, and the refrigerant can be filled to the refrigerant circuit easily.

Further, when the decided result of the refrigerant amount deciding means indicate that the refrigerant amount from one of "normal" or "excess", the compressor is stopped, so that a worker can easily carry out the refrigerant filling operation.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

What is claimed is:

1. A refrigerant filling apparatus of a refrigerating and air conditioning apparatus, comprising:

a refrigerant circuit having a compressor, a four-way valve, an indoor side heat exchanger, a pressure reducing apparatus, an outdoor side heat exchanger, and a liquid collecting device;

a refrigerant cylinder connected to the refrigerant circuit;

a control unit for controlling refrigerant filling from the refrigerant cylinder to the refrigerant circuit, and for deciding a filling mode; and a display unit for displaying the filling mode of the refrigerant, which is mounted to the control unit, wherein the refrigerant is filled from the refrigerant cylinder to the refrigerant circuit while the refrigerating and air conditioning apparatus is in operation.

2. A refrigerant filling apparatus of a refrigerating and air conditioning apparatus, comprising:

a refrigerant circuit having a compressor, a four-way valve, an indoor side heat exchanger, a pressure reducing apparatus, an outdoor side heat exchanger, and a liquid collecting device;

a refrigerant cylinder connected to the refrigerant circuit;

a control unit for controlling refrigerant filling from the refrigerant cylinder to the refrigerant circuit, and for deciding a filling mode;

a display unit for displaying the filling mode of the refrigerant, which is mounted to the control unit; and a temperature detecting apparatus for monitoring a mode of the refrigerant circuit.

3. A refrigerant filling method of the refrigerating and air conditioning apparatus, comprising: a refrigerant circuit having a compressor, a four-way valve, an indoor side heat exchanger, a pressure reducing apparatus, an outdoor side heat exchanger, a liquid collecting device; a temperature detecting apparatus that detects at least a room temperature, an outside temperature, a condensation temperature, an evaporation temperature, and outside temperatures of the indoor side heat exchanger or the outdoor side heat exchanger serving as an evaporator and a condenser; a refrigerant cylinder connected to a low pressure side of the refrigerant circuit at a time of refrigerant filling; and a control unit that controls the refrigerant filling from the refrigerant cylinder to the refrigerant circuit, and that decides a filling mode, wherein a refrigerant filling amount deciding operation stops by switching the four-way valve at the same time as stopping the compressor when a refrigerant amount mode deciding value is normal.

4. The refrigerant filling method of the refrigerating and air conditioning apparatus according to claim 3, wherein the refrigerant filling amount deciding operation stops by fully opening the pressure reducing apparatus when the refrigerant amount mode deciding value is normal.

5. The refrigerant filling method of the refrigerating and air conditioning apparatus according to claim 3, wherein the control apparatus has a display unit, at which a fact that the refrigerant is extremely lacking is displayed on the display unit when the refrigerant amount is "low", and the refrigerant filling is performed promptly.

6. The refrigerant filling method of the refrigerating and air conditioning apparatus according to claim 3 having an indoor unit and an outdoor unit, and in case of installing the pressure reducing apparatus to the outdoor unit, an operation of the refrigerating and air conditioning apparatus is a heating operation.

7. The refrigerant filling method of the refrigerating and air conditioning apparatus according to claim 3 having an indoor unit and an outdoor unit, and in case of installing the pressure reducing apparatus to the outdoor unit, an operation of the refrigerating and air conditioning apparatus is a cooling operation.

8. The refrigerant filling method of the refrigerating and air conditioning apparatus according to claim 3, wherein an operation time of not adding the refrigerant amount is changed, depending on the outside temperature.

9. The refrigerant filling method of the refrigerating and air conditioning apparatus according to claim 8, the operation time of not adding the refrigerant amount from the refrigerant cylinder is shorter in a case the outside temperature is higher than a predetermined temperature, than in a case that the outside temperature is lower than the predetermined temperature.

10. The refrigerant filling method of the refrigerating and air conditioning apparatus according to claim 3, wherein the control unit has a display unit, wherein the control unit calculates the refrigerant amount mode deciding value in real time, and a calculated result of the control unit is displayed on the display unit.

11. The refrigerant filling method of the refrigerating and air conditioning apparatus according to claim 3, for a case in which the refrigerant amount mode deciding value is "deficient" or "low", a maximum amount of the refrigerant that can be filled during a predetermined time is within 3% of a necessity minimum limit of the refrigerant amount being pre-enclosed in the refrigerant circuit.

12. The refrigerant filling method of the refrigerating and air conditioning apparatus according to claim 3, wherein the control unit records an operation log after finishing the refrigerant filling amount deciding operation.

13. A refrigerant filling method of the refrigerating and air conditioning apparatus comprises a refrigerant circuit having a compressor, a four-way valve, a condenser, a pressure reducing apparatus, an evaporator, and a liquid collecting device; temperature detecting means that detects a temperature of the refrigerant circuit and an ambient air temperature of the condenser; control means that includes refrigerant amount deciding means which decide a refrigerant amount inside the refrigerant circuit, and includes storing means that stores at least a threshold value of a decision of the refrigerant amount deciding means; display means that informs to outside by displaying a refrigerant amount mode determined in the refrigerant amount deciding means; and a refrigerant supplying apparatus connected to the refrigerant circuit; the refrigerant filling method, comprising:

a hose connecting step that connects the refrigerant supplying apparatus and a refrigerant filling inlet of the refrigerant circuit with a refrigerant filling hose;

an operation selecting step that selects a refrigerant amount deciding and displaying operation by the refrigerant amount deciding means and the displaying means;

an initiation operation step that performs an initiation operation for a predetermined time when the refrigerant amount deciding and displaying operation is selected in the operation selecting step;

a deciding and displaying step that detects a supercooling level of the condenser every time a predetermined time has passed, after the initiation operation time by the initiation operation step has passed, and an ambient air temperature of the condenser by the temperature detecting means, decides the refrigerant amount of the refrigerant circuit as "deficient", "normal" or "excess" based on a supercooling level and an ambient temperature value, and displays the decided result on the displaying means;

a refrigerant filling step that operates a shutoff valve provided to the refrigerant supplying apparatus while the compressor is in operation during the refrigerant amount deciding result of the deciding and displaying step indicates a refrigerant amount "deficient" mode; and a stopping and displaying step that stops the compressor if the refrigerant amount deciding result of the deciding and displaying step indicates a refrigerant amount mode from one of "normal" or "excess", and displays the refrigerant amount mode by the displaying means.

14. The refrigerant filling method of the refrigerating and air conditioning method according to claim 13, further comprising a time deciding step that decides a predetermined time for performing the initiation operation of the initiation operation step, by the control unit.

15. The refrigerant filling method of the refrigerating and air conditioning apparatus according to claim 14, wherein a predetermined time for performing the initiation operation is uniquely decided by the outside temperature.

16. The refrigerant filling method of the refrigerating and air conditioning apparatus according to claim 13, further comprising a shutoff valve opening and closing step which closes the shutoff valve provided to the refrigerant supplying apparatus, after displaying the refrigerant amount mode while stopping the compressor in the stopping and displaying step.

17. The refrigerant filling method of the refrigerating and air conditioning apparatus according to claim 13 which includes an indoor unit and an outdoor unit, for performing a refrigerant filling operation by constructing the refrigerant circuit capable of a cooling operation if the pressure reducing apparatus is mounted to the indoor unit, and which is capable of a heating operation if the pressure reducing apparatus is mounted to the outdoor unit.

18. The refrigerant filling method of the refrigerating and air conditioning apparatus according to claim 13, a rotation number of the compressor and a pressure reducing amount of the pressure reducing means are changed to become a predetermined target value determined from a refrigerant temperature condition of the refrigerant circuit.

19. The refrigerant filling method of the refrigerating and air conditioning apparatus according to claim 13, wherein the deciding and displaying step continues, if a refrigerant amount deciding result of the deciding and displaying step is "deficient", and if the refrigerant filling step is not executed.

20. The refrigerant filling method of the refrigerating and air conditioning apparatus according to claim 13, for switching a path of the four-way valve within few seconds after the compressor stop, in case of stopping the compressor at the refrigerant amount deciding result from one of "normal" or "excess" based on the stopping and displaying step.

21. The refrigerant filling method of the refrigerating and air conditioning apparatus according to claim 20, for notifying that the compressor has stopped due to the refrigerant amount deciding result as one of "normal" or "excess", based on a noise generated by switching a path of the four-way valve.

22. The refrigerant filling method of the refrigerating and air conditioning apparatus according to claim 13, wherein the initiation operation step measures an ambient air temperature of the condenser and a two-phase refrigerant temperature of the condenser, their difference is obtained, and if the difference is greater than a predetermined value, a threshold value of the refrigerant amount decision of "excess" in the deciding and displaying step is changed in a direction of increasing supercooling level.

23. The refrigerant filling method of the refrigerating and air conditioning apparatus according to claim 13, wherein the initiation operation step measures an ambient air temperature of the condenser and a two-phase refrigerant temperature of the condenser, and their difference is obtained, and if the difference is less than a predetermined value, a refrigerant amount "deficient" is decided before a predetermined initiation operation time elapses, and this fact is displayed.

24. A refrigerant filling apparatus of the refrigerating and air conditioning apparatus, comprising: a refrigerant circuit having a compressor, a four-way valve, a condenser, a pressure reducing solenoid valve, an evaporator, a liquid collecting device; temperature detecting means that detects a refrigerant circuit temperature and an ambient air temperature of the condenser; refrigerant amount deciding means which decide the refrigerant amount inside the refrigerant circuit; control means that includes refrigerant amount deciding means which decide the refrigerant amount of the refrigerant circuit and storing means that stores at least a threshold value of the decision based on the refrigerant amount deciding means; displaying means that displays a refrigerant amount mode decided based on the refrigerant amount deciding means and informs to outside; and a refrigerant supplying apparatus connected to the refrigerant circuit, wherein the refrigerant amount deciding means decides the refrigerant amount mode of the refrigerant circuit as one of "deficient", "normal" and "excess", and a decided result from one of "deficient", "normal" and "excess" is displayed to the displaying means.

25. The refrigerant filling apparatus of the refrigerating and air conditioning apparatus according to claim 24 for stopping the compressor, if a decided result of the refrigerant amount deciding means indicate the refrigerant amount as one of "normal" or "excess".

* * * * *